US006557912B1

(12) United States Patent
Truong

(10) Patent No.: US 6,557,912 B1
(45) Date of Patent: May 6, 2003

(54) MULTI-POSITIONAL ADVANCED DOOR SECURITY LOCK

(75) Inventor: David Truong, San Jose, CA (US)

(73) Assignee: International Business and Technology Corporation, San Jose, CA (US)

( * ) Notice: Subject to any disclaimer, the term of this patent is extended or adjusted under 35 U.S.C. 154(b) by 0 days.

(21) Appl. No.: 09/427,157

(22) Filed: Oct. 25, 1999

Related U.S. Application Data

(63) Continuation-in-part of application No. 09/305,154, filed on May 4, 1999, now Pat. No. 6,340,185, which is a continuation-in-part of application No. 09/286,134, filed on Apr. 1, 1999, now abandoned.

(51) Int. Cl.[7] ..... E05C 17/44
(52) U.S. Cl. ..... 292/338; 292/342
(58) Field of Search ..... 292/342, 343, 292/338, 339, 259 R, 202; 16/82

(56) References Cited

U.S. PATENT DOCUMENTS

| | | | | |
|---|---|---|---|---|
| 866,881 | A | 9/1907 | Parker | |
| 1,002,812 | A | 9/1911 | Moore | |
| 1,082,432 | A | 12/1913 | Mertsheimer | |
| 1,505,184 | A | 8/1924 | Zukor | |
| 1,606,084 | A | 5/1926 | Kline | |
| 1,851,612 | A | 3/1932 | Werth | |
| 3,143,369 | A | 8/1964 | Adams | |
| 3,399,918 | A | 9/1968 | Nagy | |
| 3,480,247 | A | 11/1969 | Waner | |
| 3,633,862 | A | 1/1972 | Breen | |
| 3,690,769 | A | 9/1972 | Bogusz | |
| 4,215,885 | A | 8/1980 | McCray | |
| 4,738,151 | A | 4/1988 | Russell et al. | |
| 5,071,099 | A | 12/1991 | Kuo | |
| 5,112,023 | A | 5/1992 | Sowers | |
| 5,232,255 | A | 8/1993 | Palmer et al. | |
| 5,383,254 | A | 1/1995 | Wigley, Sr. | |
| 5,490,304 | A | 2/1996 | Winner, Jr. et al. | |
| 5,676,410 | A | * 10/1997 | Angerbrandt | 292/338 |
| 5,703,735 | A | 12/1997 | Bleek | |
| 5,727,822 | A | 3/1998 | Truong | |
| 5,771,533 | A | 6/1998 | Kuang-Pin | |
| 5,826,850 | A | 10/1998 | Goldsmith | |
| 5,836,049 | A | 11/1998 | Chiang | |

FOREIGN PATENT DOCUMENTS

| | | |
|---|---|---|
| FR | 630.304 | 12/1927 |

* cited by examiner

*Primary Examiner*—Gary Estremsky
(74) *Attorney, Agent, or Firm*—Beyer Weaver & Thomas, LLP

(57) ABSTRACT

An apparatus for holding a door is disclosed. The apparatus includes a body member configured to be coupled to a floor. Further, the apparatus includes a locking member movably coupled to the body member, and having an end that is configured to engage the door. Further still, the apparatus includes a stop arrangement coupled to the locking member and configured to hold the locking member in a predetermined position relative to the body member. The predetermined position associating with a predefined door position, such that the holding prevents the door from moving past a predefined door position when the locking member is engaged with the door.

88 Claims, 20 Drawing Sheets

MULTI-POSITIONAL ADVANCED DOOR SECURITY LOCK

CROSS REFERENCE TO RELATED APPLICATION

The present application is a Continuation-In-Part of U.S. Patent Application titled, "A Multi-Positional Advanced Door Security Lock", U.S. patent Ser. No. 09/305,154, filed May 4, 1999 now U.S. Pat. No. 6,340,185, which is also a Continuation-In-Part of U.S. Patent Application titled, "An Advanced Door Security Lock", U.S. patent Ser. No. 09/286,134, filed Apr. 1, 1999 now abandoned, both of which are incorporated herein by reference in their entirety for all purposes.

BACKGROUND OF THE INVENTION

The present invention relates to methods and apparatus for use in home and office security. More particularly methods and apparatus for securely keeping a door from being forcibly broken down, both while it is closed and while it is partially open, are disclosed.

Crime rates, particularly rates pertaining to home-invasion crimes, are on the rise. As such, the issue of home security is of considerable concern to many people. Since a substantial percentage of home-invasion crimes begin with the act of a door being broken down, specialized door security devices have been developed to prevent doors from being broken down from the outside.

Although existing door security devices in the market today have been shown to be effective in preventing doors from being broken down from the outside when the door is completely closed, these existing devices are not particularly effective at securing the door in its partially open state, e.g., when the occupant desires to open the door partially to identify the caller, to receive mail or packages, to allow in pets, or the like. Further, many existing door security devices are complex and difficult to use (e.g., lock, unlock, engage, disengage, etc.), and as a result, a user may have trouble opening the door during emergencies where time is crucial. For example, during a fire a person may not have time to unlock and/or disengage the lock.

In view of the foregoing, what are desired are improved methods and apparatus for securely keeping a door from being forcibly broken down, both in its closed state and in its partially open state.

SUMMARY OF THE INVENTION

The invention relates, in one embodiment, to an apparatus for holding a door. The apparatus includes a body member configured to be coupled to a floor. The apparatus further includes a locking member movably coupled to the body member, and having an end that is configured to engage the door. The apparatus additionally includes a stop arrangement coupled to the locking member and configured to hold the locking member in a predetermined position relative to the body member. The predetermined position associating with a predefined door position, such that the holding prevents the door from moving past a predefined door position when the locking member is engaged with the door.

The invention relates, in another embodiment, to an apparatus for holding a swinging door. The apparatus including a door mounting plate configured to be mounted to the door. The apparatus further including a floor mounting plate configured to be mounted to a floor. The apparatus additionally including a body member coupled to the floor mounting plate. The apparatus further including a locking member slidably coupled to the body member, and having an end that is configured to be coupled to the door mounting plate. The apparatus also including a stop arrangement configured to hold the locking member in at least one predetermined position relative to the body member.

The stop arrangement including a stop ridge coupled to the locking member, and a stop plate pivotly coupled to the body member and arranged to engage a portion of the stop ridge. The stop ridge and the stop plate being configured to cooperate to prevent the locking member from sliding past the predetermined position when the stop plate is engaged with the stop ridge, wherein when the door mounting plate is mounted to the door, the floor mounting plate is mounted to the floor, the locking member is coupled to the door mounting plate, and the stop arrangement is holding the locking member, then the door is prevented from moving in at least one direction.

The invention relates, in another embodiment, to an apparatus for holding a swinging door. The apparatus including a door mounting plate configured to be mounted to the door. The apparatus further including a floor mounting plate configured to be mounted to a floor. The apparatus additionally including a body member coupled to the floor mounting plate. The apparatus further including a locking member slidably coupled to the body member, and having an end that is configured to be coupled to the door mounting plate. The apparatus also including a stop arrangement configured to hold the locking member in at least one predetermined position relative to the body member.

The stop arrangement including a stop ridge coupled to the locking member, and arranged to engage a portion of the body member. The stop ridge and the body member being configured to cooperate to prevent the locking member from sliding past the predetermined position when the stop ridge is engaged with the body member, wherein when the door mounting plate is mounted to the door, the floor mounting plate is mounted to the floor, the locking member is coupled to the door mounting plate, and the stop arrangement is holding the locking member, then the door is prevented from moving in at least one direction.

The invention relates, in another embodiment, to an apparatus for preventing a door from being forcibly opened from either a first predefined position or a second predefined position, the door being opened further in the second predefined position than in the first predefined position. The apparatus including a door mounting plate configured to be mounted to the door. The apparatus further including a floor mounting plate configured to be mounted to a floor. The apparatus additionally including a body member coupled to the floor mounting plate. The apparatus further including a locking member slidably coupled to the body member, and having an end that is configured to be coupled to the door mounting plate. The apparatus also including a stop arrangement configured to hold the locking member in either a first predetermined position or a second predetermined position relative to the body member.

The stop arrangement including a stop ridge coupled to the locking member, and arranged to engage a portion of the body member, and a stop plate pivotly coupled to the body member, and arranged to engage a portion of the stop ridge. The stop ridge and the stop plate being configured to cooperate to prevent the locking member from sliding past the first predetermined position when the stop plate is engaged with the stop ridge. The stop ridge and the body member being configured to cooperate to prevent the locking member from sliding past the second predetermined position when the stop ridge is engaged with the body member, wherein when the door mounting plate is mounted to the door, the floor mounting plate is mounted to the floor, the locking member is coupled to the door mounting plate, and the stop arrangement is holding the locking member in the first predetermined position, then the door is prevented from moving past the first predefined position, and wherein when the door mounting plate is mounted to the door, the floor mounting plate is mounted to the floor, the locking member is coupled to the door mounting plate, and the stop arrangement is holding the locking member in the second predetermined position, then the door is prevented from moving past the second predefined position.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be obvious, however, to one skilled in the art, that the present invention may be practiced without some or all of these specific details. In other instances, well known structures and process steps have not been described in detail in order not to unnecessarily obscure the present invention.

Figure 1:
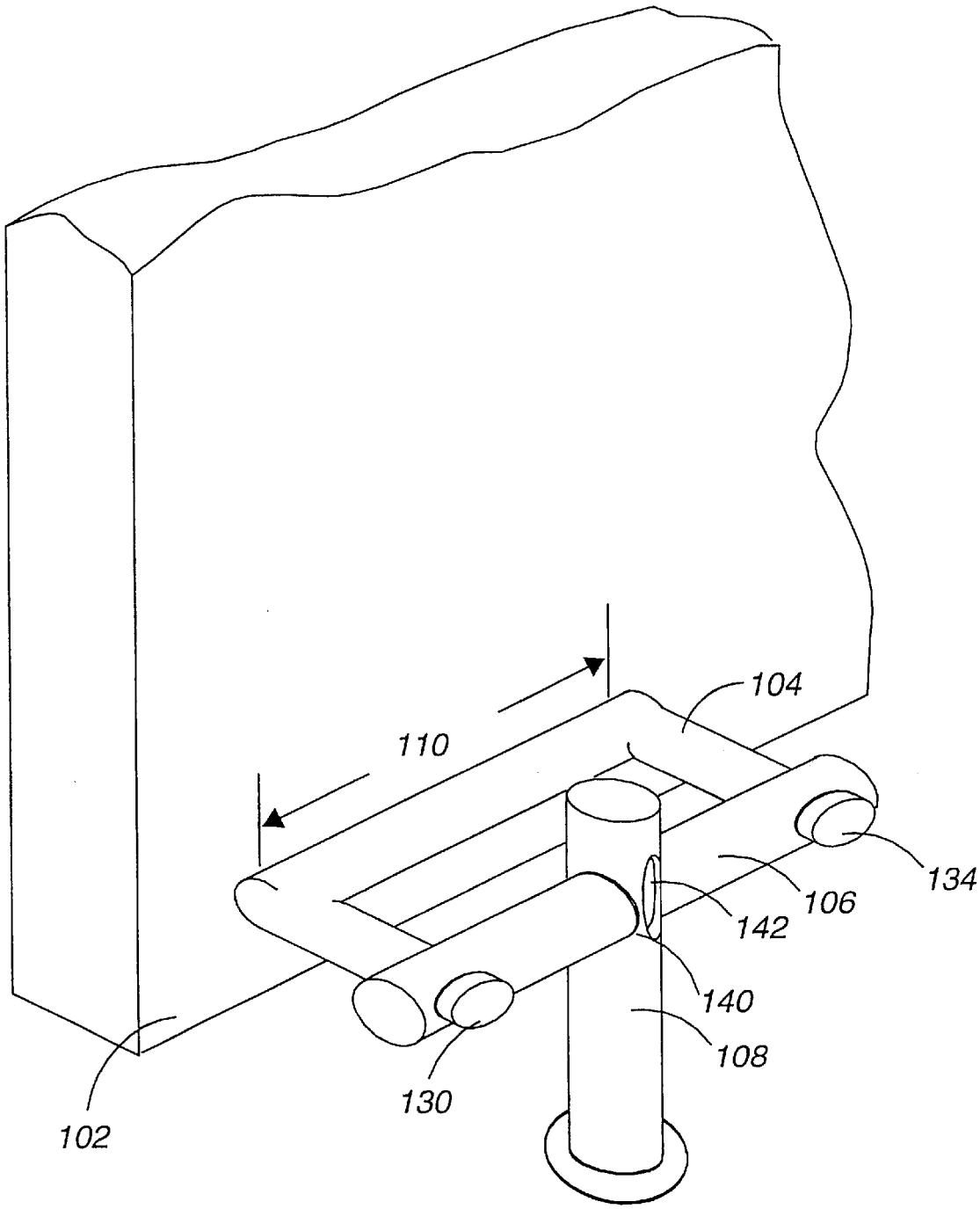
FIG. 1 is an illustration of an Advanced Door Security lock in accordance with a preferred embodiment of the present invention.

Referring initially to FIG. 1, there is shown an Advanced Door Security (ADS) lock in accordance with a preferred embodiment of the present invention. The ADS lock comprises a lock-arm 104, a bar 106, and a body member 108. Lock-arm 104 is mechanically coupled to bar 106, and the combination of lock-arm 104 and bar 106 forms what will herein be referred to as a blocking member. The blocking member is rotatably coupled to body member 108. In this embodiment, the blocking member is comprised of lock-arm 104 and bar 106, which are formed as individual pieces. However, in general, the blocking member may be made up of only one piece, i.e., lock-arm 104 and bar 106 may be formed as a single part.

In order for the ADS lock to secure a door, the ADS lock must is mounted to a floor, or a similar surface, at the foot of a door such that when an attempt is made at opening the door, the door contacts the ADS lock. In some cases, the ADS lock may be mounted directly into the floor. In others, body member 108 may be mounted in a receptacle (not shown) which may be attached to the floor using mechanical screws or an adhesive. The receptacle may also include holes or a sleeve to physically support body member 108.

In this embodiment, body member 108 is mounted vertically in front of a door 102 it is intended to secure. The location of body member 108 is such that when the blocking member of the ADS lock is in a first blocking position, lock-arm 104 makes contact with door 102 to hold it in a first predefined position as shown in FIG. 1. Typically, when door 102 is closed, it is considered to be in the first predefined position although this first predefined position may also represent a slightly open door. The portion of lock-arm 104 which contacts door 102 when the blocking member is in a first blocking position is herein referred to as a blocking edge 110. When body member 108 is positioned in front of door 102, blocking edge 110 is positioned in the first blocking position such that blocking edge 110 comes into contract with door 102 to hold it in the first predefined position. More preferably, blocking edge 110 is in a horizontal position, i.e., it is parallel to the plane of the floor.

The blocking member is rotatably coupled to body member 108 by means of a thru-hole 140 in body member 108 in which bar 106 of the blocking member is placed. Thru-hole 140 should be large enough to accommodate bar 106 and provide enough clearance to allow bar 106 to rotate in thru-hole 140 about its center-line. As bar 106 rotates, due to the fact that lock-arm 104 is mechanically coupled to bar 106, lock-arm 104 and blocking edge 110 also rotate with respect to the center-line of bar 106.

The rotation of bar 106 is preferably mechanically constrained, i.e., bar 106 is free to rotate only within a fixed range. A pin (shown in greater detail in subsequent FIGS. 2 and 3) is inserted into bar 106 through a thru-slot 142 in body member 108. The pin rotates within thru-slot 142 and serves to constrain the rotation of bar 106. Rotation is constrained when the pin reaches the bottom of thru-slot 142, thereby holding the blocking member at either the first blocking position or the second blocking position.

In one embodiment, when the blocking member is in the second blocking position, ends 130 and 134 of lock-arm 104 make contact with door 102 to hold it at a second predefined position. In some cases, depending upon the dimensions of body member 108, body member 108 may come into contact with door 102 to furnish a third point of contact to more securely hold door 102 in the second predefined position.

The second blocking position of the blocking member holds door 102 in the second predefined position, which is generally a position in which door 102 is opened wider than it is when it is in a first predefined position. By way of example, in some embodiments, the first predefined position will be when door 102 is closed, and the second predefined position will be when door 102 is open approximately 2.5 inches. In others, the blocking member is preferably dimensioned such that second predefined position is reached when door 102 is open approximately 3 feet, e.g., enough to allow a single person to enter as in crowd control applications. In general, the second blocking position may be reached by rotating the body member away from the first blocking position. More preferably, the blocking member is placed at the second blocking position by rotating it 180 degrees from the first blocking position, e.g., by flip it around the axis of bar 106.

Alternatively, it is contemplated that the blocking member, when in the first blocking position, is disposed such that its plane is substantially parallel to the ground and points toward the door, i.e., its blocking edge is closer to the door than the bar. In the second blocking position, the blocking member may be mechanically constrained at a slight angle, preferably pointing toward the door, to permit the door to be slightly open. The angle may be either upward or downward. Further, it is contemplated that mechanical devices, e.g., a spring, may be provided to help the blocking member to return to the first blocking position from the second blocking position.

Figure 2:
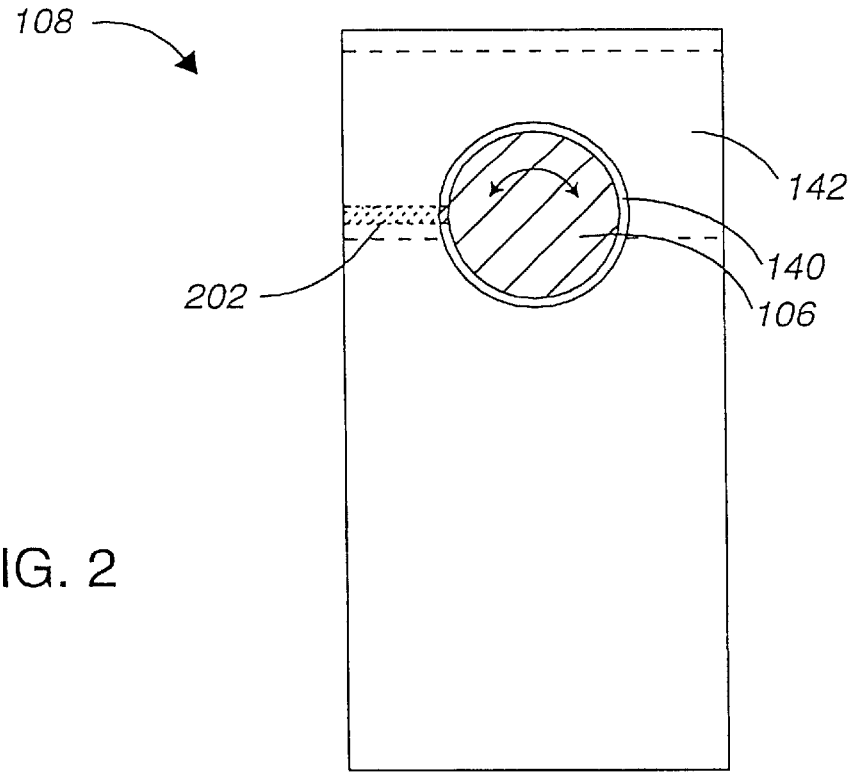
FIG. 2 is a cross-sectional illustration of a first configuration of the body member of an Advanced Door Security lock in accordance with a preferred embodiment of the present invention.

Referring next to FIG. 2, a cross-sectional illustration of a configuration of aforementioned body member 108 will be described in detail. As previously mentioned with respect to FIG. 1, thru-hole 140 in body member 108 serves to hold bar 106 while enabling the bar to rotate about its center-line. Bar 106 contains a pin 202 which rotates in thru-slot 142 with bar 106 (and constrained when pin 202 reaches the bottom of thru-slot 142. In this configuration, bar 106 and the lock-arm, e.g. bar 106 and lock arm 104 of FIG. 1, which comprise the blocking member as previously described must be made of more than one piece to enable bar 106 to be inserted through the thru-hole 140.

Figure 3:
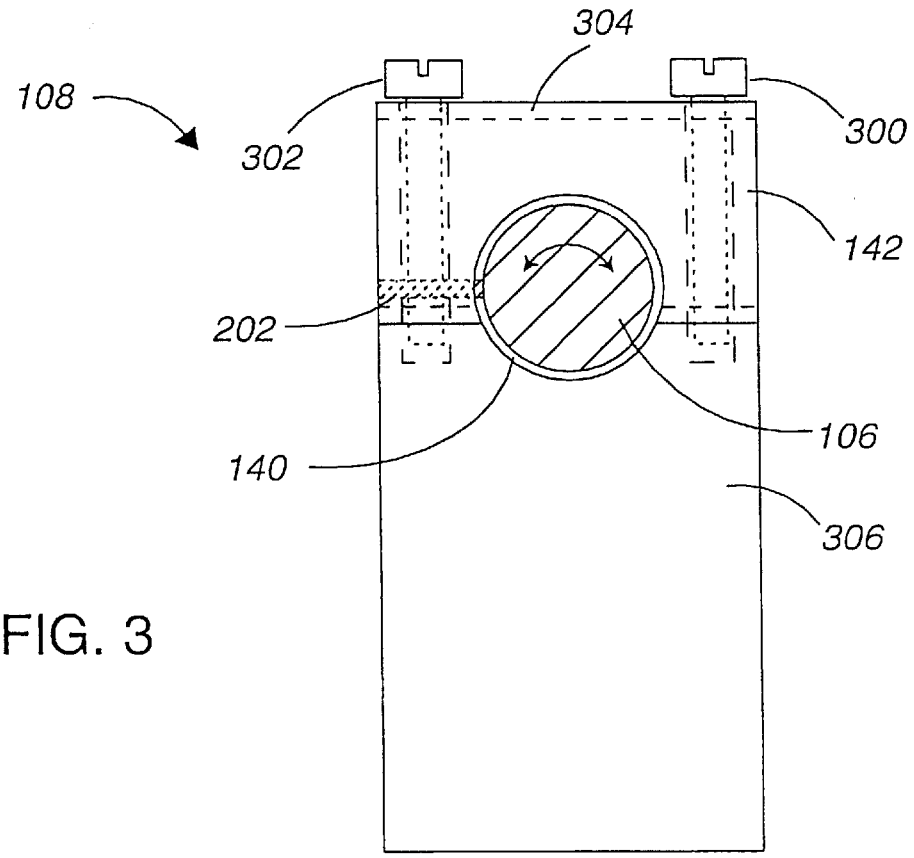
FIG. 3 is a cross-sectional illustration of a second configuration of the body member of an Advanced Door Security lock in accordance with a preferred embodiment of the present invention.

FIG. 3 is a cross-sectional illustration of another configuration of body member 108. In this configuration, body member 108 is comprised of two pieces, a body stem 306 and a body cap 304, which are held together with fasteners 300 and 302. Fasteners 300 and 302 may represent, for example, screws or the like. Pin 202 and thru-slot 142 are again shown. As described with respect to FIG. 2, thru-hole 140 in body member 108 serves to hold bar 106 which, in turn, contains pin 202. As previously mentioned, pin 202 rotates in thru-slot 142 while bar 106 rotates about its center-line. In this configuration, the lock-arm, as for example lock-arm 104 as described with reference to FIG. 1, and bar 106 are not required to be constructed of more than one piece. The fact that body member 108 is comprised of body stem 306 and body cap 304 makes it possible for a one-piece blocking member to be placed in thru-hole 140.

Figure 4:
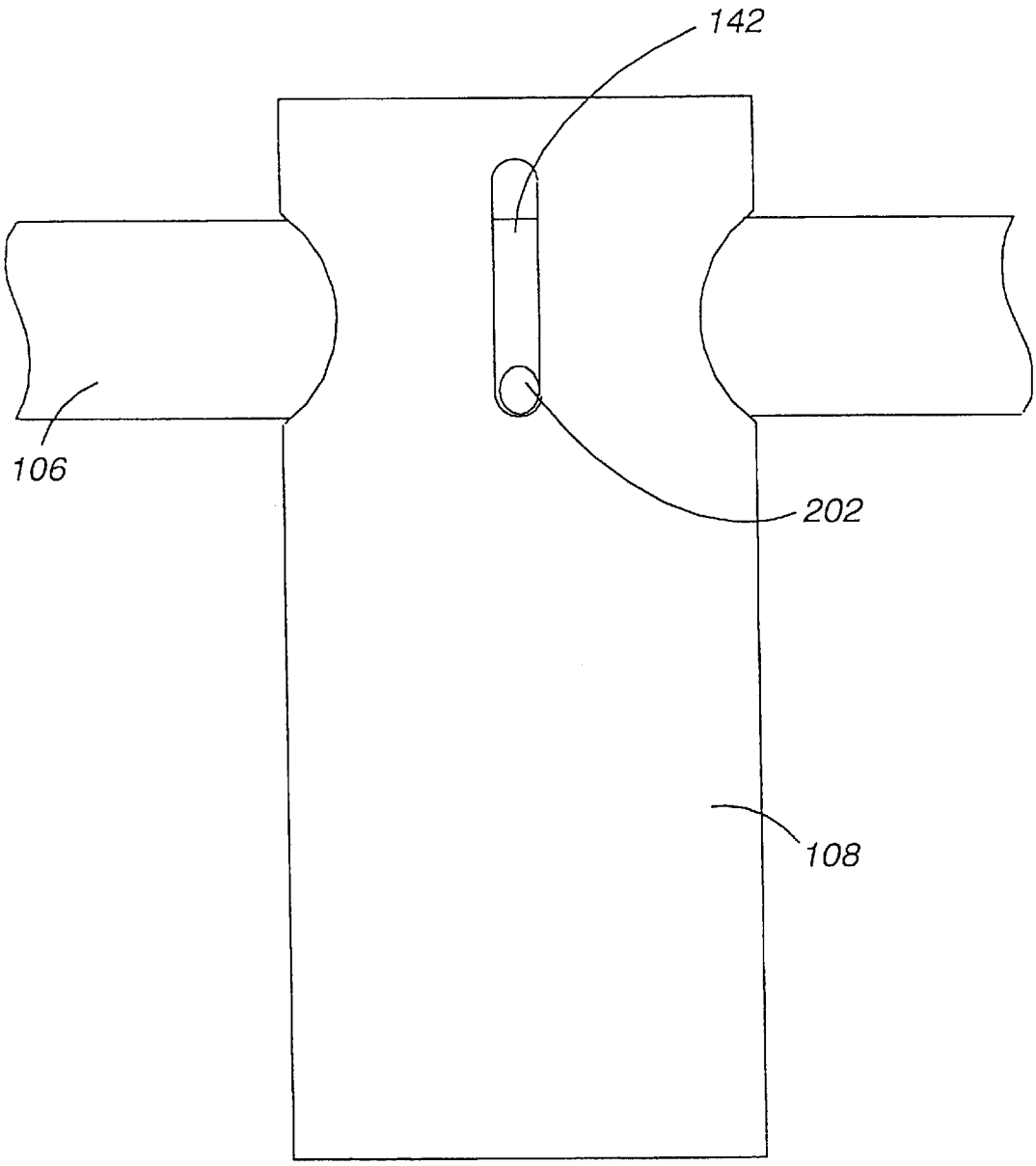
FIG. 4 is an illustration of the body member of an Advanced Door Security lock shown with the mechanism which constrains the rotation of the bar and the blocking member of the Advanced Door Security lock in accordance with a preferred embodiment of the present invention.

Referring next to FIG. 4, the mechanism which serves to constrain rotation of bar 106 (and concomitantly of the blocking member) will be explained in detail. FIG. 4 is an illustration of body member 108, which is shown as being of a one-piece construction, although it may also be comprised of two pieces as described above with reference to FIG. 3. Bar 106 contains pin 202 which rotates in thru-slot 142 and serves to constrain the rotation of bar 106 as it rotates about its center-line. When pin 202 comes to rest at the bottom of thru-slot 142, as shown, bar 106 is constrained from rotating any further in the direction it was rotating when pin 202 came to a rest. It should be clear that thru slot 142 extends through the bar; as such, pin 202 may come to rest in two positions, the position as shown in FIG. 4, and a position on the other side of body member 108.

Figure 5:
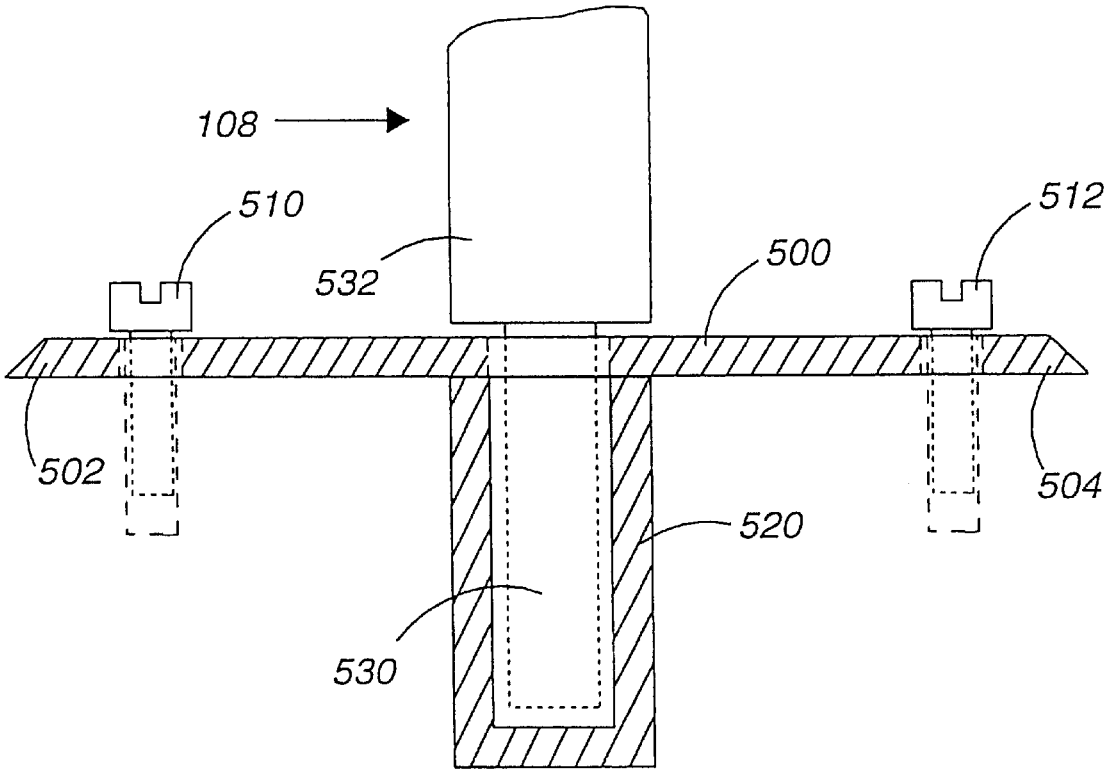
FIG. 5 is a cross-sectional illustration of a receptacle which is used to support an Advanced Door Security lock in accordance with a preferred embodiment of the present invention.

FIG. 5 is a cross-sectional illustration of a receptacle which may be used to support body member 108 of the ADS lock to more securely hold the ADS lock to the floor. Body member 108, as shown in FIG. 5, is a rod comprised of sections 532 and 530 which may have different diameters. The receptacle is comprised of a plate 500 which is mounted on a floor or similar surface to support body member 108. Plate 500 has a portion 520, e.g., a sleeve or a closed-end tube, which may be embedded into an opening in the floor and serves to more securely hold section 530 of body member 108. Alternatively, portion 520 may be integral with the plate, i.e., the sleeve or the closed-end tube is selfcontained within the plate, so no alteration or drilling of the floor is necessary. This embodiment is highly advantageous in situations where it is not possible or desirable to create a hole in the floor to accommodate a portion 520 that is in the floor. To further reduce the alteration to the floor, the plate may be attached to the floor using, for example, an appropriate adhesive. Plate 500 may also have tapered edges 502 and 504, which serve to create a smooth transition between the boundary of plate 500 and the floor. Either an adhesive or fasteners 510 and 512, e.g., screws or the like, may be used to secure plate 500 to the floor.

Figure 6:
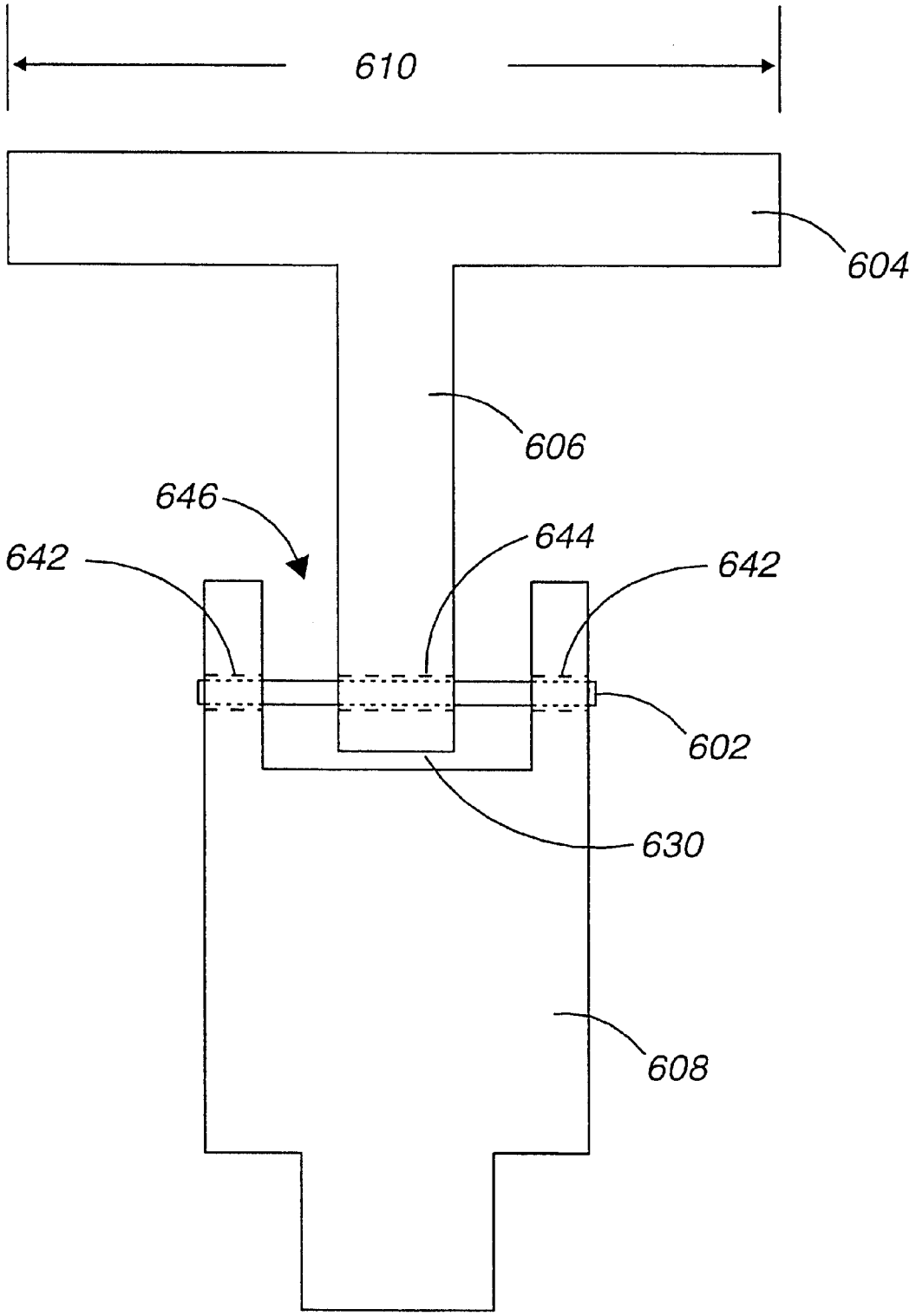
FIG. 6 is a cross-sectional illustration of an Advanced Door Security lock in accordance with a second preferred embodiment of the present invention.

Referring next to FIG. 6, there is shown a cross-sectional illustration of an ADS lock in accordance with another preferred embodiment of the present invention. The ADS lock of this embodiment comprises a lock-arm 604, a bar 606, and a body member 608. Lock-arm 604 is analogous in function to lock-arm 104 of the previous embodiment. Similarly, bar 606 and body member 608 are analogous in function to bar 106 and body member 108, respectively, as shown in FIG. 1. As before, the combination of lock-arm 104 and bar 106 comprises a blocking member. The blocking member as shown in FIG. 6 is shaped like the letter "T." The blocking member is rotatably coupled to body member 608. In this embodiment, the blocking member is comprised of one piece, although lock-arm 604 and bar 606 may be separate elements which are mechanically coupled. A blocking edge 610, analogous in function to blocking edge 110, comes into contact with a door to hold it in a first predefined position.

To hold the door in a second predefined position, the blocking member is preferably rotated such that an end 630 of bar 606 contacts the door. End 630 is analogous in function to ends 130 and 134 as described with reference to FIG. 1, contacts the door. A pin 602 passes through a thru-slot 642 which extends through body member 608 to hold the blocking member while enabling it to rotate. The arch through which the blocking member may rotate is constrained by a notch 646 in the body member 608. When bar 606 contacts the bottom of notch 646 in body member 608, the blocking member is stopped from rotating any further in the direction in which it was rotating when contact was made.

As described above, a receptacle may be used to support a body member of an ADS lock. The receptacle depicted in FIG. 5 includes a plate and a portion that is arranged to be embedded into an opening in a floor. Although such a receptacle is generally effective in supporting the body member of an ADS lock, such a receptacle typically requires that a portion of a floor be bored, or otherwise hollowed, out to house the receptacle. In some situations, hollowing out a floor for more than screw holes may prove to be undesirable. By way of example, if the receptacle is to be moved from a first position to a second position, a portion of the floor will typically be bored out for each receptacle position. The bored out portion associated with the first position may then cause an obstacle to individuals walking on the floor, e.g., the heel of a person's shoe may be caught in the bored out portion. In addition, the portion of the receptacle that is embedded in the floor may prove to be an obstacle as well.

Figure 7:
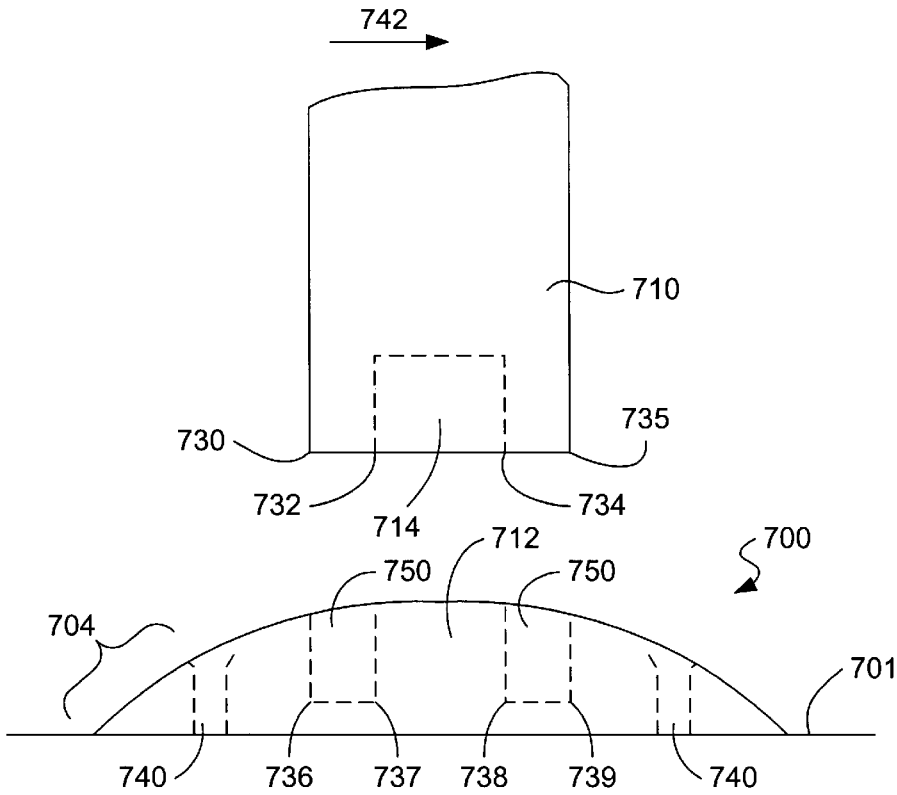
FIG. 7 is a diagrammatic cross-sectional side-view representation of a portion of a body member of an Advanced Door Security lock and a base plate in accordance with a third preferred embodiment of the present invention.

It should be appreciated that the design of a receptacle may generally be widely varied. FIG. 7 is a diagrammatic cross-sectional side-view representation of a portion of a body member, or a post, of an ADS lock and a receptacle, or a base plate, for supporting the ADS lock in accordance with a third embodiment of the present invention. A base plate 700, i.e., a mounting plate, is arranged such that substantially no portion of base plate 700 penetrates a surface 701, e.g., a surface of a floor, when base plate 700 is fixed with respect to surface 700. Since substantially no portion of base plate 700 penetrates surface 701, base plate 700 may be moved relatively easily to different surfaces, as portions of surfaces generally need not be bored out in order to receive portions of base plate 700. In addition to being more portable than a receptacle which is at least partially mounted in a floor, by not requiring the floor to be bored out, the use of base plate 700 reduces the potential disfacement, or marring, of surface 701.

Further, since base plate 700 does not include a relatively large opening that extends below surface 701, into which a body member is to be inserted, it is less likely that a person wearing a high-heeled shoe will get her heel caught in the opening. Hence, base plate 700 may generally be less of an obstacle than, for example, plate 500 of FIG. 5.

Base plate 700 has a sloped profile, as indicated by a slope 704. While slope 704 may vary, slope 704 is arranged such that base plate 700 is not likely to be tripped over by an individual walking over base plate 700. Since the likelihood of an individual walking over base plate 700 is fairly high, due to the fact that base plate 700 is typically mounted near a door, choosing slope 704 such that base plate 700 has a relatively low profile may prevent accidents.

A body member 710, referred to herein as a post, is arranged to be inserted over a protrusion 712 of base plate 700. Protrusion 712 extends above a bottom surface of base plate 700, i.e., the surface of base plate 700 which is arranged to interface with surface 701, and is arranged to engage a cavity 714 defined in body member 710. Specifically, as shown, protrusion 712 and cavity 714 are arranged to cooperate to support post 710 within respect to base plate 700.

As will be understood by those skilled in the art, a higher aspect ratio, or ratio of height to width, of a hole used to support post 710 increases the rigidity associated with supporting post 710. Increasing the rigidity, in turn, serves to increase the overall effectiveness of an ADS lock that includes post 710. Protrusion 712 increases the aspect ratio associated with base plate 700 over the aspect ratio of a similar base plate with no protrusion.

A channel 750 surrounds protrusion 712 and is arranged to contact post 710. Channel 750 includes a portion 736, a portion 737, a portion 738, and a portion 739. Portion 736 is arranged to contact a portion 730 of post 710 when post 710 is inserted in base plate 700. Similarly, a portion 732 of post 710 is arranged to contact portion 737, a portion 734 of post 710 is arranged to contact portion 738, and a portion 735 is arranged to contact portion 739, when post 710 is inserted in base plate 700. The contact between the various portions of post 710 and base plate 700 serves to keep post 710 positioned within base plate 700. In addition, the contact between the different portions increases the amount of force necessary, over the force needed without the use of protrusion 712 and channel 750, to dislodge post 710 from base plate 700 when a force is applied against post 710. Specifically, the contact between portion 730 and portion 736 as well as the contact between portion 734 and portion 738 increases the magnitude of the force necessary in an axial direction 742 to dislodge post 710. Likewise, the contact between portion 732 and portion 737 as well as the contact between portion 735 and portion 739 increases the magnitude of the force necessary in the opposite direction from axial direction 742 to dislodge post 710. That is, the security and stability of post 710 with respect to base plate 700 is enhanced with the "four-point contact" between post 710 and base plate 700.

The size of protrusion 712 and, hence, channel 750 may vary widely. However, in the described embodiment, the dimensions of channel 750 and protrusion 712 in axial direction 742 are chosen such that, together, they are substantially equal to the axial dimension of post 710. In addition, the dimension of channel 750 in axial direction 742, i.e., the width of channel 750, is typically chosen to be narrow enough to prevent the heel of a high-heeled shoe from catching channel 750 or otherwise becoming lodged in channel 750. Since base plate 700 is typically located at or close to a door in a doorway, individuals will typically walk over or on base plate 700. Therefore, preventing heels from being caught in base plate 700 is likely to prevent injuries to individuals.

Thru-holes 740 are arranged such that screws (not shown) may be used to fasten base plate 700 to surface 701. Although four thru-holes 740 have been shown, it should be appreciated that the number, as well as the location, of thru-holes 740 may be widely varied. In one embodiment, thru-holes 740 are counter bored, or counter sunk, to prevent screw heads used to mount base plate 700 to surface 701 from protruding past the top surface of base plate 700. That is, thru-holes 740 may be counter bored to prevent screw heads from providing an obstacle over which an individual may trip.

Figure 8:
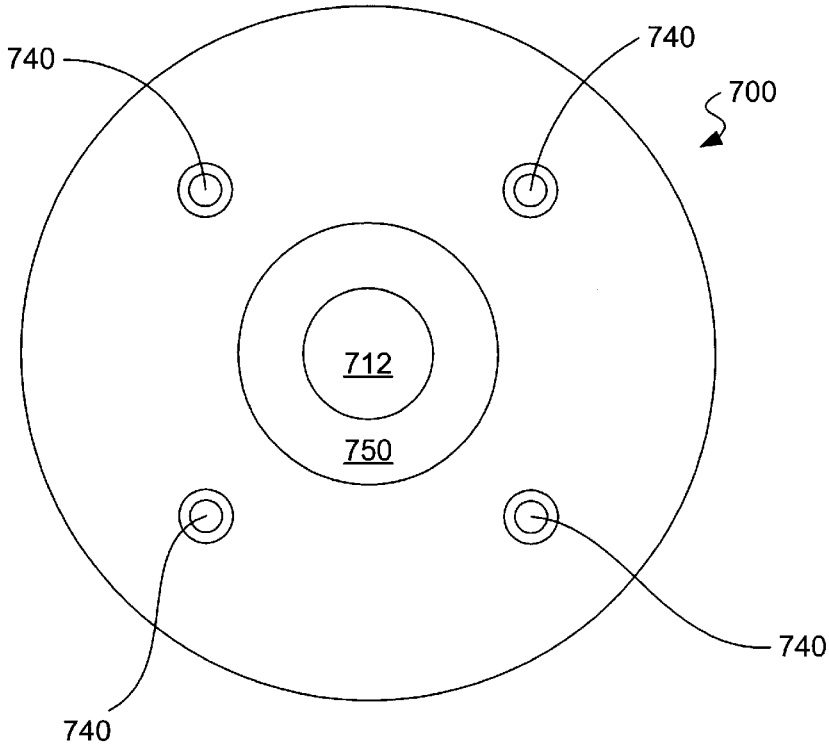
FIG. 8 is a diagrammatic top-view representation of the base plate of FIG. 7 in accordance with the third preferred embodiment of the present invention.

FIG. 8 is a diagrammatic top-view representation of base plate 700. As shown, base plate 700 has a substantially circular shape, and thru-holes 740 are substantially evenly spaced with respect to protrusion 712. It should be appreciated that for ease of illustration, the components of base plate 700 have not necessarily been shown to scale.

In general, base plate 700 is formed from a material that is relatively resistant to wear and tear. Preferably, base plate 700 is formed from a rigid material such as a metal or a metal alloy. In one embodiment, base plate 700 may be formed from stainless steel. Alternatively, other materials, which include but are not limited to hard plastics, may be used in the formation of base plate 700.

Figure 9:
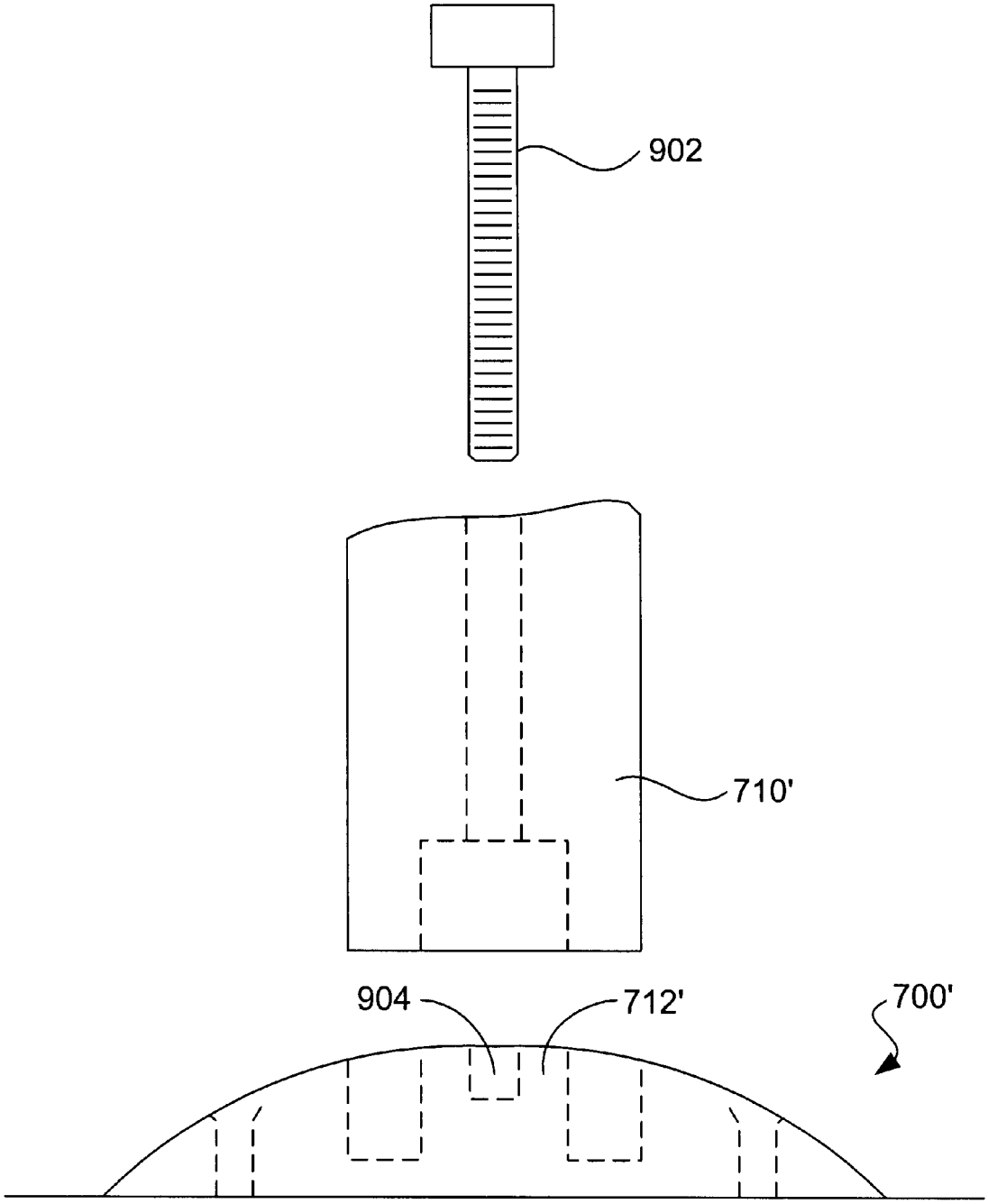
FIG. 9 is a diagrammatic cross-sectional side-view representation of a base plate arranged for use with a securing mechanism and a portion of a body member of an Advanced Door Security lock, also as arranged for use with a securing mechanism, in accordance with a fourth preferred embodiment of the present invention.

Referring back to FIG. 7, in addition to utilizing protrusion 712 and channel 750 to effectively engage post 710, reinforcing mechanisms may be used to further secure post with respect to base plate 700. In other words, base plate 700 and post 710 may be modified such that an additional securing mechanism may be used to strengthen the coupling between base plate 700 and post 710. While the additional securing mechanism that is used may be widely varied, in one embodiment, the securing mechanism may be a screw 902 designed to pass longitudinally through a post 710' and screw into a threaded opening 904 in a protrusion 712' of a base plate 700', as indicated in FIG. 9.

Figure 10:
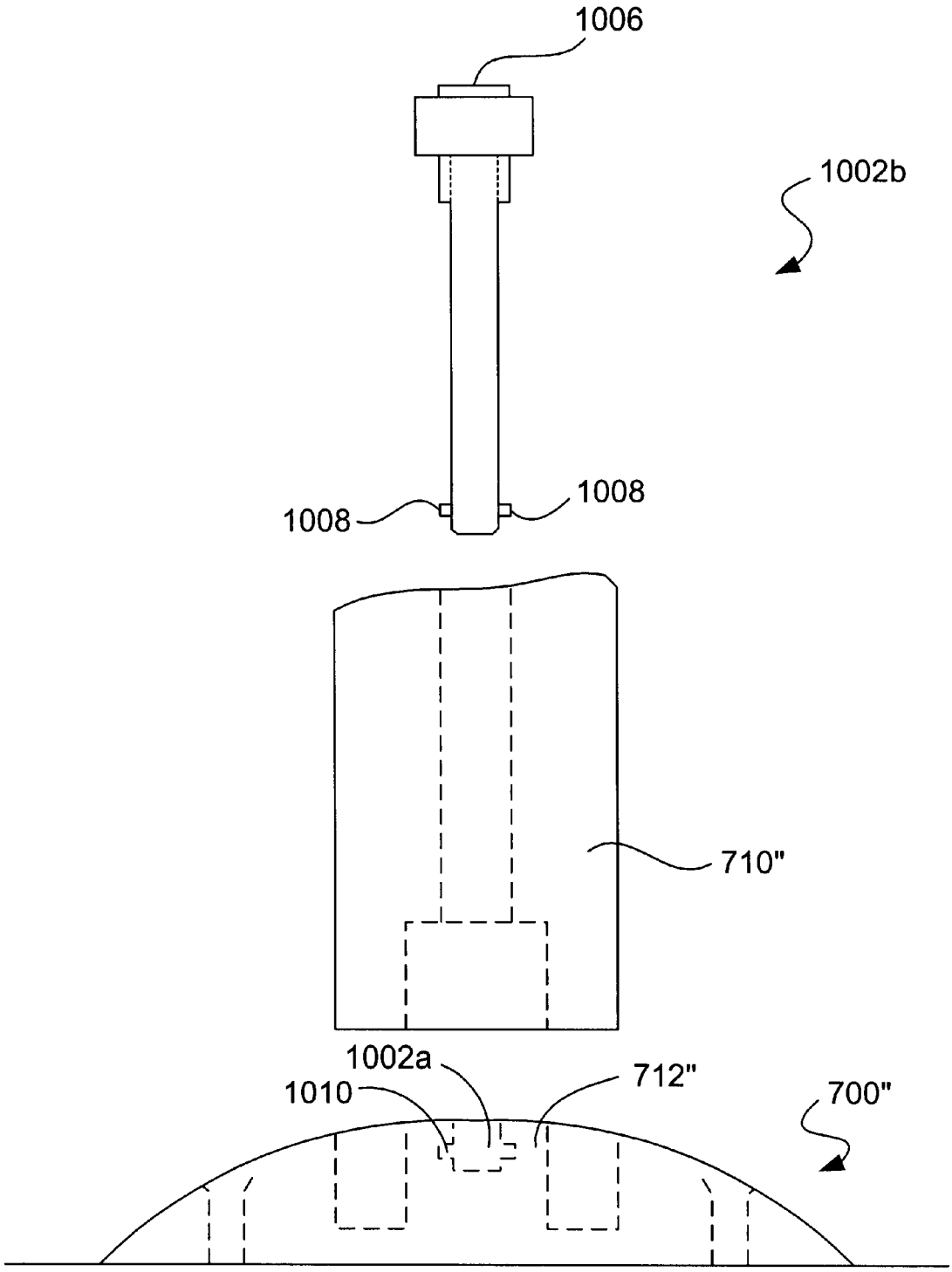
FIG. 10 is a diagrammatic cross-sectional side-view representation of a base plate arranged for use with a securing mechanism and a portion of a body member of an Advanced Door Security lock, also as arranged for use with a securing mechanism, in accordance with a fifth preferred embodiment of the present invention.

In another embodiment, the additional securing mechanism used to strengthen the coupling between a post 710" and a protrusion 712" of a base plate 700" may be a snap lock arrangement 1002, as shown in FIG. 10. Snap lock arrangement 1002 includes a lock receptacle 1002*a* that is embedded with respect to protrusion 712', and a "snap" 1002*b* which is arranged to snap into lock receptacle 1002*a*. Once snap 1002*b* is coupled to lock receptacle 1002*a,* snap 1002*b* may be removed, for instance, by pressing down on a release button 1006 and turning snap 1002*b* with respect to lock receptacle 1002*a,* as will be appreciated by those skilled in the art. Typically, pressing down on release button 1006 will retract balls 1008 which are arranged to fit in grooves 1010 of lock receptacle 1002*a*. Hence, release button 1006 may be used to enable snap 1002*b* to both be placed into and removed from lock receptacle 1002*a*.

In accordance with another aspect of the present invention, the ADS lock is reconfigured to work with both inward and outward swinging doors. In this embodiment, the blocking member is replaced by a locking member that is slidably coupled to the body member. The locking member is configured to have a plurality of locking positions that will lock the door when the door is shut, when the door is partially opened away from the ADS lock or when the door is partially opened towards the ADS lock. Additionally, the locking member is advantageously coupled to the door. By coupling the locking member to the door the unwanted disengagement of an ADS locked door is prevented.

Figures 11A, 11B, 11C, 11D:
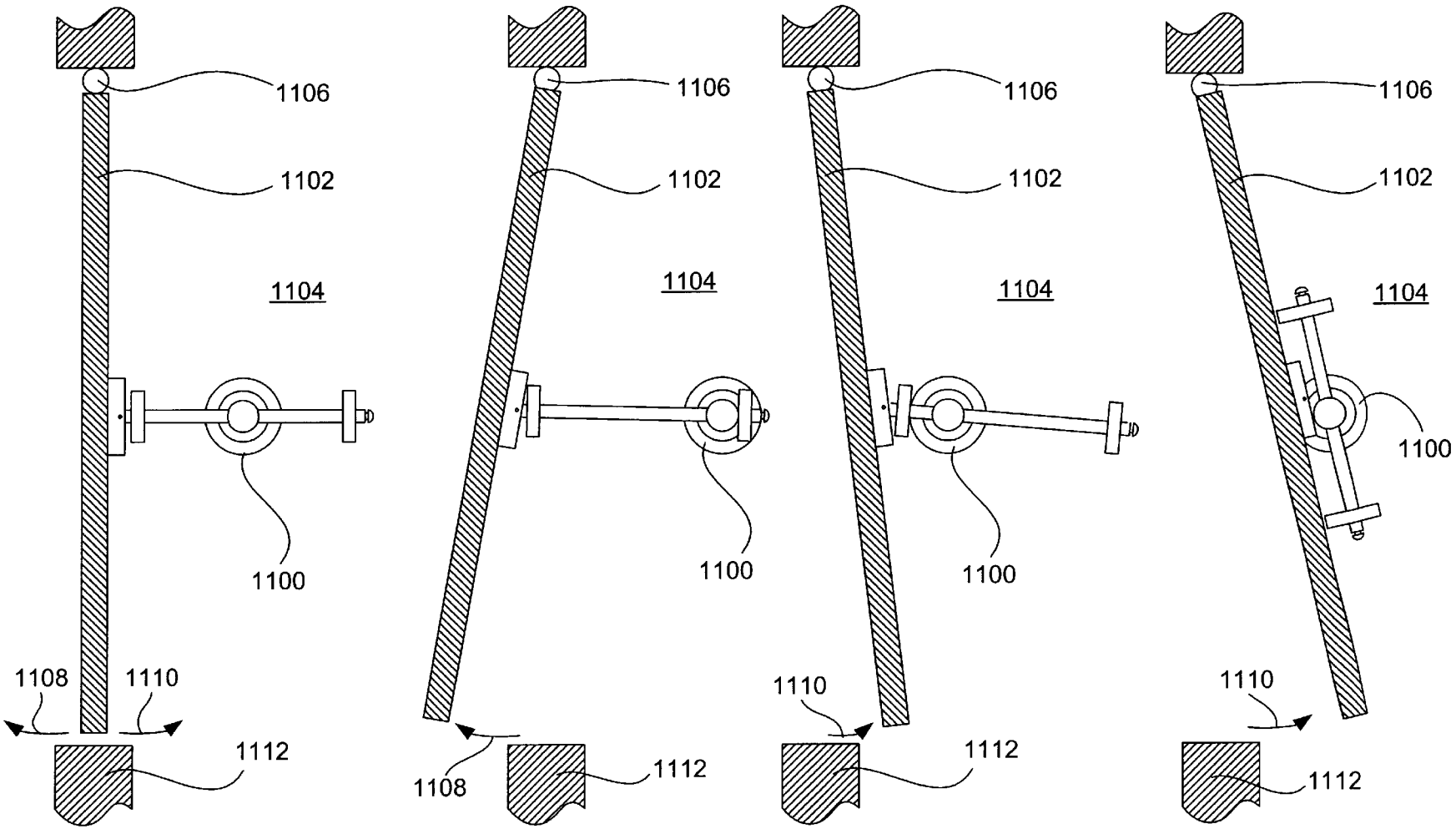
FIGS. 11A–11D show, in accordance with several embodiments of the present invention, a top view of four multi-positional ADS lock arrangements.

Referring to FIGS. 11A–11D, a top view of the multi-positional ADS lock 1100 is shown in multiple arrangements. In all four figures, multi-positional ADS lock 1100 is mounted to a surface 1104, which may be a floor or a ceiling. Typically, door 1102 includes a pivot point 1106 that enables door 1102 to swing along an outside path 1108 and/or an inside path 1110. In FIG. 11A, multi-positional ADS lock 1100 is coupled to door 1102 and is configured to prevent door 1102 from swinging along inside path 1110 and/or outside path 1108. Ideally, this arrangement locks the door in the door shut position wherein the door cannot be pulled or pushed open.

In FIG. 11B, the multi-positional lock is coupled to door 1102 and is configured to prevent door 1102 from swinging in a direction away from the multi-positional ADS lock (e.g., outside swinging door). Basically, the door cannot be pulled past a predefined door position. Ideally, this arrangement provides a small opening between door 1102 and a door frame 1112 wherein select items may be passed from one side of the door to the other or the identity of a person standing outside may be ascertained.

In FIG. 11C, the multi-positional lock is coupled to door 1102 and is configured to prevent door 1102 from swinging in a direction towards the multi-positional ADS lock (e.g., inside swinging door). Basically, the door cannot be pushed past a predefined door position. Ideally, this arrangement provides a small opening between door 1102 and a door frame 1112 wherein select items may be passed from one side of the door to the other or the identity of a person standing outside may be ascertained.

In FIG. 11D, the multi-positional lock is configured to prevent door 1102 from swinging in a direction towards the multi-positional ADS lock (e.g., inside swinging door). In this Figure, the multi-positional ADS lock is not required to be coupled to the door to prevent the door from opening past the location of the multi-positional ADS lock. Basically, the door cannot be pushed past a predefined door position, which is set by the location of the multi-positional ADS lock behind the door. Again, this arrangement provides a small opening between door 1102 and door frame 1112 wherein select items may be passed from one side of the door to the other or the identity of a person standing outside may be ascertained.

Preferably, the opening in FIGS. 11B–11D is configured to be large enough for mail and other similar items and small enough to limit intruder access (e.g., between about 2 to 3 in.). Further, all four positions of the door may be achieved when the multi-positional ADS lock is placed within the confines of the interior of the door, which prevents an intruder from disengaging the multi-positional ADS lock, or even attempting to cut through to gain entry. Also, it is preferable to position the multi-positional ADS lock between the center of the door (as shown) and the outside edge of the door (e.g., edge opposite the door pivot). As is well known in the art, the closer the multi-positional ADS lock is to the outside edge of the door (e.g., near the opening) the stronger the multi-positional ADS lock is in withstanding forces. However, this is not a limitation and any multi-positional ADS lock position that can withstand the forces of an intruder may be used.

Figure 12A:
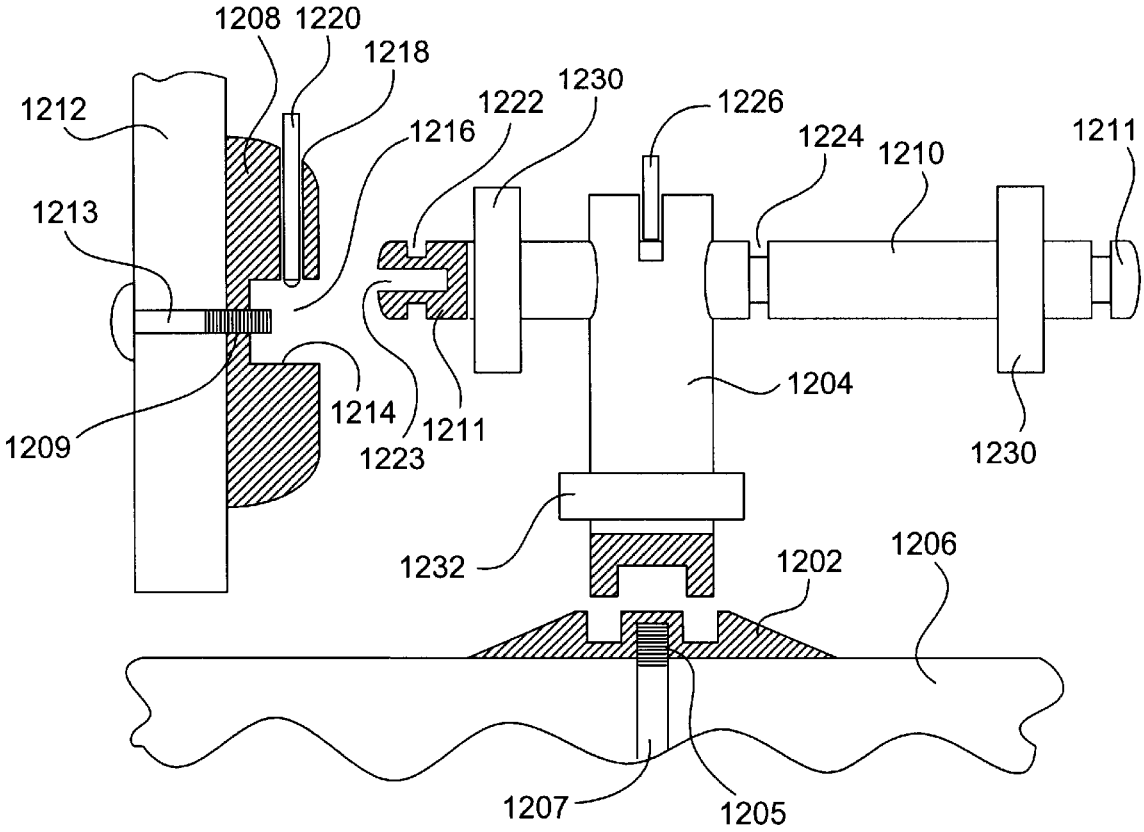
FIGS. 12A & 12B illustrate, in accordance with one embodiment of the present invention, a side view of the multi-positional ADS lock.

To facilitate discussion of the multiple aspects of the present invention, FIG. 12A illustrates a multi-positional ADS lock arrangement 1100 having a floor mounting plate 1202 and a body member 1204. It should be noted that the floor mounting plate maybe similar to the previously described base plate. In one embodiment, floor mounting plate 1204 is preferably configured to be mounted to a floor 1206 and includes a recess for receiving body member 1204. In some instances, the floor mounting plate further includes a protrusion disposed inside the recess for additional securement and to prevent objects and shoe heels from being caught inside the recess.

Correspondingly, one end of body member 1204 is configured to cooperate with the recess and/or protrusion of floor mounting plate 1202 such that when the body member is disposed inside the floor mounting plate, the body member is substantially immovable in a lateral direction. In this manner, the body member is substantially coupled to the floor. Preferably, the floor mounting plate and the body member are formed from a material that can withstand the forces of an unwanted intruder (e.g., steel or hard polymer such as plastic). It should be noted that the multi-positional ADS lock arrangement is not limited by the use of a floor mounting plate and that any means suitable for coupling the body member to the floor (e.g., hole in the floor whether or not reinforced with a sleeve) may be used so long as the body member is substantially immovable by a force exerted by an intruder pushing or pulling on a door (e.g., lateral direction).

In one embodiment, the floor mounting plate is configured to include a threaded portion 1205 that coincides with a threaded portion on an anchor bolt 1207 that is fixed in the floor. This arrangement is configured to mount floor mounting plate 1202 to floor 1206. Preferably, the anchor bolt is formed from a material that can withstand the forces of an unwanted intruder (e.g., steel or hard polymer such as plastic). It should be borne in mind that the anchor bolt arrangement is not a limitation and that any means suitable for coupling the floor mounting plate to the floor may be used so long as it is strong enough to withstand the force of an intruder pulling or pushing on a door. In fact, as mentioned in the discussion about the base plate, the floor mounting plate may include a plurality of holes for mounting the floor mounting plate to the floor with screws.

Additionally, multi-positional ADS lock 1100 includes a door mounting plate 1208 and a locking member 1210. Locking member 1210 is slidably coupled to body member 1204. However, it should be noted that the locking member may be coupled in a variety of ways, e.g., structurally coupled, pivotally coupled or rotatably coupled. Typically, locking member 1210 is disposed substantially perpendicular to body member 1204. Although not shown in FIG. 12A, the body member preferably includes a thru-hole that is configured to slidably receive the locking member. Moreover, locking member 1210 further includes a locking member binding end 1211 that is configured to engage door mounting plate 1208. Locking member binding end 1211 includes a binding slot 1222 that is part of a locking mechanism that couples the door mounting plate to the locking member. Optionally, both ends of the locking member may have a locking member binding end. Preferably, locking member 1210 is a rigid member that is formed from a material that can withstand the forces of an unwanted intruder (e.g., steel or hard polymer such as plastic).

Furthermore, door mounting plate 1208 is configured to be mounted to an interior portion of a door 1212 and arranged to extend perpendicularly therefrom. In most instances, door mounting plate 1208 is adjacently coupled to door 1212. In one embodiment, door mounting plate 1208 is configured to include a threaded portion 1209 that coincides with a threaded portion on a bolt 1213. Bolt 1213 is inserted through an aperture in door 1212 and is configured to couple door mounting plate 1208 to door 1212 (as shown in FIG. 12). Preferably, the bolt mounting arrangement prevents an outside intruder from removing the multi-positional ADS lock by placing the securing means inside door 1212. Typically, bolt 1213 connects to thread 1209 in the center of door mounting plate 1208. However, a plurality of bolts and thread locations may be used.

Alternatively, door mounting plate 1208 may be attached to door 1212 by screws that pass through the door mounting plate 1208 into door 1212 such that the screws are completely inaccessible from outside. Additionally, the door mounting plate may be mounted to the door by a plurality of bolts that are structurally coupled to an exterior plate that is located outside of the door. Typically, the bolts pass through a plurality of apertures in the door and are fastened to the door mounting plate. Preferably, the bolts are fastened with coinciding nuts located inside the door (e.g., so that an intruder cannot remove).

Figure 12B:
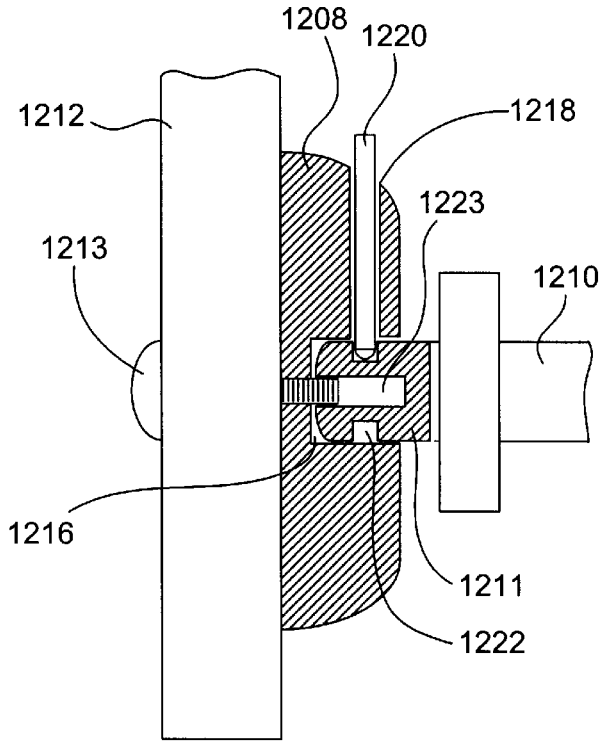

In a preferred embodiment, the door mounting plate is configured to couple to the locking member binding end. Referring to FIG. 12B, door mounting plate 1208 includes a door binding portion 1214 that is used to temporarily couple locking member 1210 to door mounting plate 1208. Preferably, door binding portion 1214 includes an opening 1216 that is configured to receive the locking member binding end. Typically, opening 1216 has a shape that coincides with the cross sectional shape of locking member binding end 1211. In this manner, a portion of the locking member binding end may be disposed inside opening 1216 of door binding portion 1214.

Furthermore, door binding portion 1214 includes a cavity 1218 for slidably holding a pin 1220. Cavity 1218 runs parallel to the surface of the door (as shown in FIG. 12B) from an outer peripheral surface of the door mounting plate to opening 1216. Preferably, pin 1220 is configured to coincide with binding slot 1222 of the locking member binding end. In this manner, the pin may be disposed inside the binding slot when the locking member binding end is positioned in the opening of the door binding portion. Preferably, the pin and binding slot engagement couples the locking member to the door mounting plate. Additionally, the pin advantageously creates a pivot point between the door mounting plate and the locking member that allows some play when the multi-positional ADS lock is moved to one of its locking positions.

In one embodiment, pin 1220 is spring biased towards the center of door mounting plate 1208, thereby automatically engaging the binding slot, when the binding slot is aligned with the pin. In this manner, the user is able to easily connect the locking member to the door mounting plate. To disengage the pin, a user would have to pull against the spring bias as the locking member is pulled away from the opening. Additionally, locking member binding end 1211 may include a binding end opening 1223 for accepting at least a portion of bolt 1213, when the door binding portion is engaged with the locking member binding end. In this manner, the binding linkage is further secured from lateral disengagement. It should be noted that the pin and binding slot combination is not a limitation and that any suitable locking mechanism that can couple the door mounting plate to the locking member may be used (i.e., clamps, threads, spring locks, etc.).

Figure 13A:
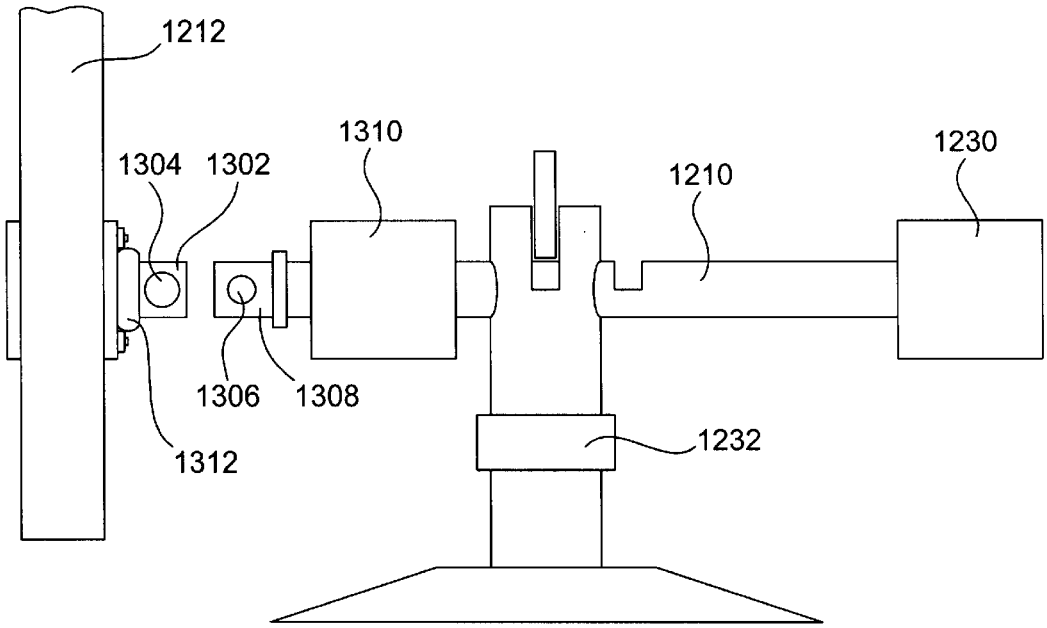
FIGS. 13A & 13B illustrate, in accordance with one embodiment of the present invention, an alternate embodiment of the multi-positional ADS lock that uses a nub, nub aperture and collar binding linkage.

In alternate embodiment, the door binding portion may include an extension that extends in the perpendicular direction away from the door mounting plate. As shown in FIG. 13A, an extension 1302 includes a nub aperture 1304 for mating with a binding nub 1306, which is located in a locking member binding end 1308 at one end of locking member 1210. Correspondingly, when binding nub 1306 is disposed inside nub aperture 1304, locking member 1210 is substantially coupled to door mounting plate 1208. The binding nub engages the aperture by rotating the body member about the base plate. Furthermore, because of the dynamics of the nub/aperture linkage the extension may be configured to be movable so that the linkage will not pinch. Although FIG. 13A shows an engagement that is parallel to the floor, it should be noted that the engagement may also be made in a direction perpendicular to the floor, such as in embodiments where the locking member is pivotally coupled to the body member.

Figure 13B:
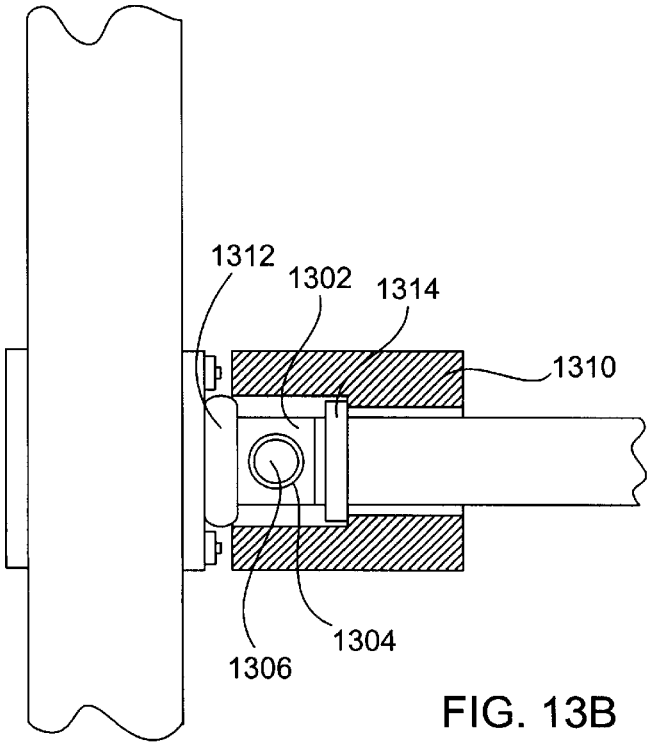

In some instances, the binding nub and nub aperture combination may need additional securement to prevent disengagement of the locking member and the door mounting plate. As shown in FIG. 13B, a collar 1310 is slidably coupled around locking member 1210. Collar 1310 is configured to slide over at least a portion of the nub/aperture linkage to prevent binding nub 1306 from disengaging from nub aperture 1304. Furthermore, locking member 1210 includes a collar stop 1314 for placing collar 1310 in the proper position over the nub/aperture linkage. Preferably, the collar is formed from a material that can withstand the forces of an unwanted intruder (e.g., steel or hard polymer such as plastic). Additionally, a gasket 1312 may be disposed around extension 1302 to stiffen the play between the binding nub and nub aperture. It should be noted that the collar is not a limitation and any means suitable for securing the binding nub and nub aperture combination may be used (i.e., twist locks, spring locks, screw locks, pin locks, etc).

Figure 14A:
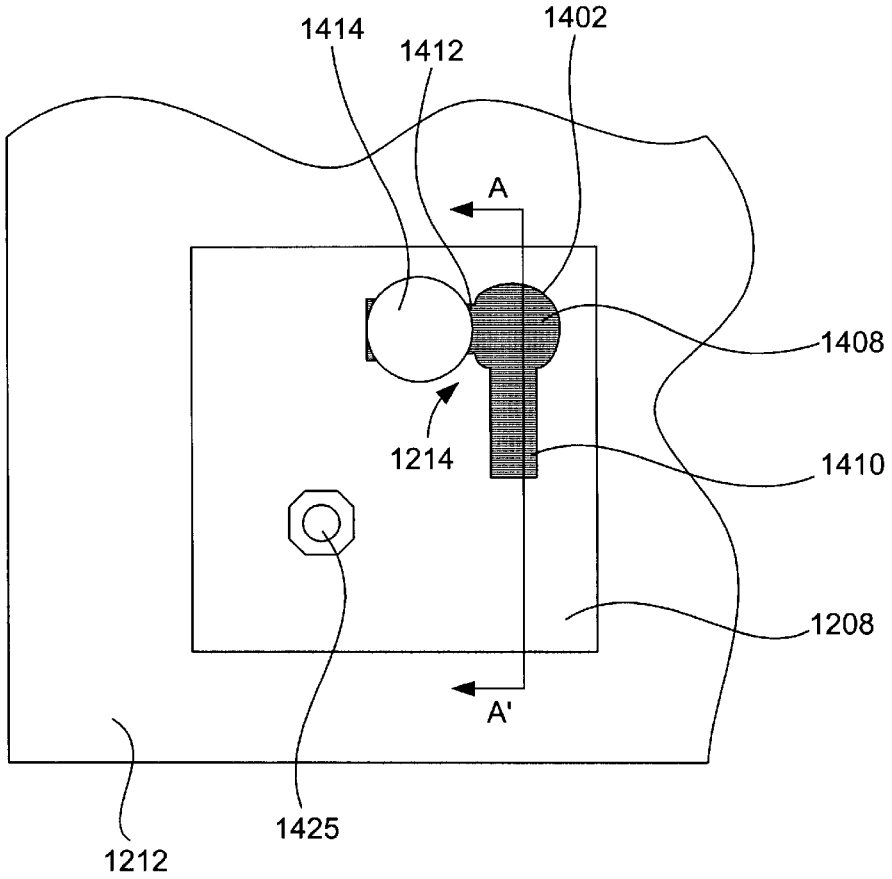
FIGS. 14A & 14B illustrate, in accordance with one embodiment of the present invention, an alternate embodiment of the multi-positional ADS lock that uses a mating head and notch binding linkage.
Figure 14B:
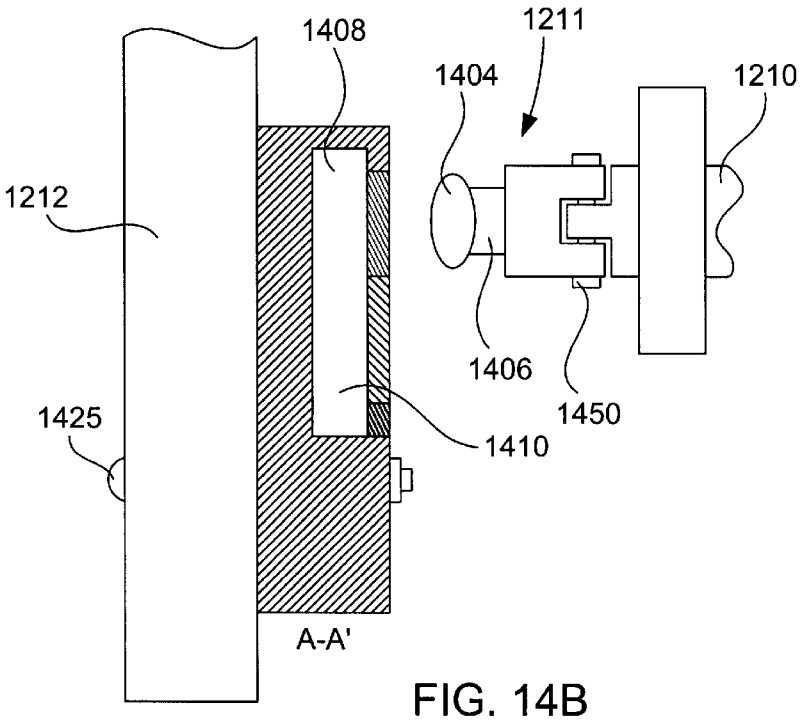

In another embodiment, the binding linkage (e.g., door binding portion and locking member binding end) may be configured as a notch guide and a mating head. Referring to FIGS. 14A–B, door binding portion 1214 includes a notch guide 1402 and locking member binding end 1211 includes a mating head 1404 and a mating neck 1406. Preferably, the cross sectional shape of mating head 1404 is larger than the cross sectional shape of mating neck 1406. Notch guide 1402 includes a mating opening 1408 and a notch 1410. Furthermore, notch 1410 extends away from mating opening 1408 in a direction perpendicular to the floor. Mating opening 1408 is configured to accept the cross sectional shape of mating head 1404 and notch 1408 is configured to accept the cross sectional shape of neck 1406.

Moreover, mating head 1404 may be disposed in mating opening 1408 and moved along notch 1410. Basically, the head is slidably coupled to the door binding portion when disposed in the notch. Because notch 1410 is smaller than mating head 1404, mating head 1410 is substantially bound in place in directions that are parallel to the floor (when in the notch). For this reason, a locking mechanism is provided to prevent movement of the mating head in a direction perpendicular to the floor (e.g., direction of notch). Preferably, door binding portion 1214 further includes a locking channel 1412 that is connected to mating opening 1408 for slidably coupling a slide lock 1414. Ideally, the locking channel direction is parallel to the floor. Correspondingly, when the mating head is disposed in the notch, the slide lock is moved to a locking position that is adjacent to the location of the mating head thereby locking the mating head in place. It should be noted that the locking mechanism is not limited to a slide lock and that any suitable locking mechanism that can hold the head in place may be used (e.g., spring biased pin). Similarly to the above mentioned methods, door mounting plate 1208 includes an aperture for accepting a bolt 1425 that is used to mount the door mounting plate to the door.

In an alternate embodiment, the locking member binding end is pivotally coupled to the locking member. As previously mentioned, a pivot point may be needed at the coupling between the locking member and the door mounting plate to eliminate pinching that typically occurs when the multi-positional ADS lock is moved to an open position (FIGS. 11B and 11C). Referring to FIG. 14B, a pivot pin 1450 is disposed in a portion of locking member binding end 1211 and a portion of locking member 1210 to pivotally couple locking member binding end 1211 to locking member 1210. Pivot pins are well known in the art, and for the sake of brevity will not be discussed in detail.

The multi-positional ADS lock further includes a stop arrangement configured to hold the locking member in at least one predetermined position relative to the body member. Correspondingly, the door is prevented from moving past a predefined door position (e.g., door shut, door partially open).

In one embodiment, the stop arrangement is configured as a slot and stop plate. Typically, the slot is a cut away portion of the locking member. The stop plate is configured to coincide with the geometry of the slot and abut to a portion of the body member (e.g., inner portion, outer portion) to prevent the locking member from sliding relative to the body member when the stop plate is disposed in the slot. Preferably, this stop arrangement is used in doors that are closed. In another embodiment of the present invention, the stop arrangement is configured as a blocking portion that is coupled to the locking member. The blocking portion is configured to abut to an outer portion of the body member to prevent the locking member from sliding relative to the body member. Preferably, this stop arrangement is used in doors that open away from the multi-positional lock.

Figure 15:
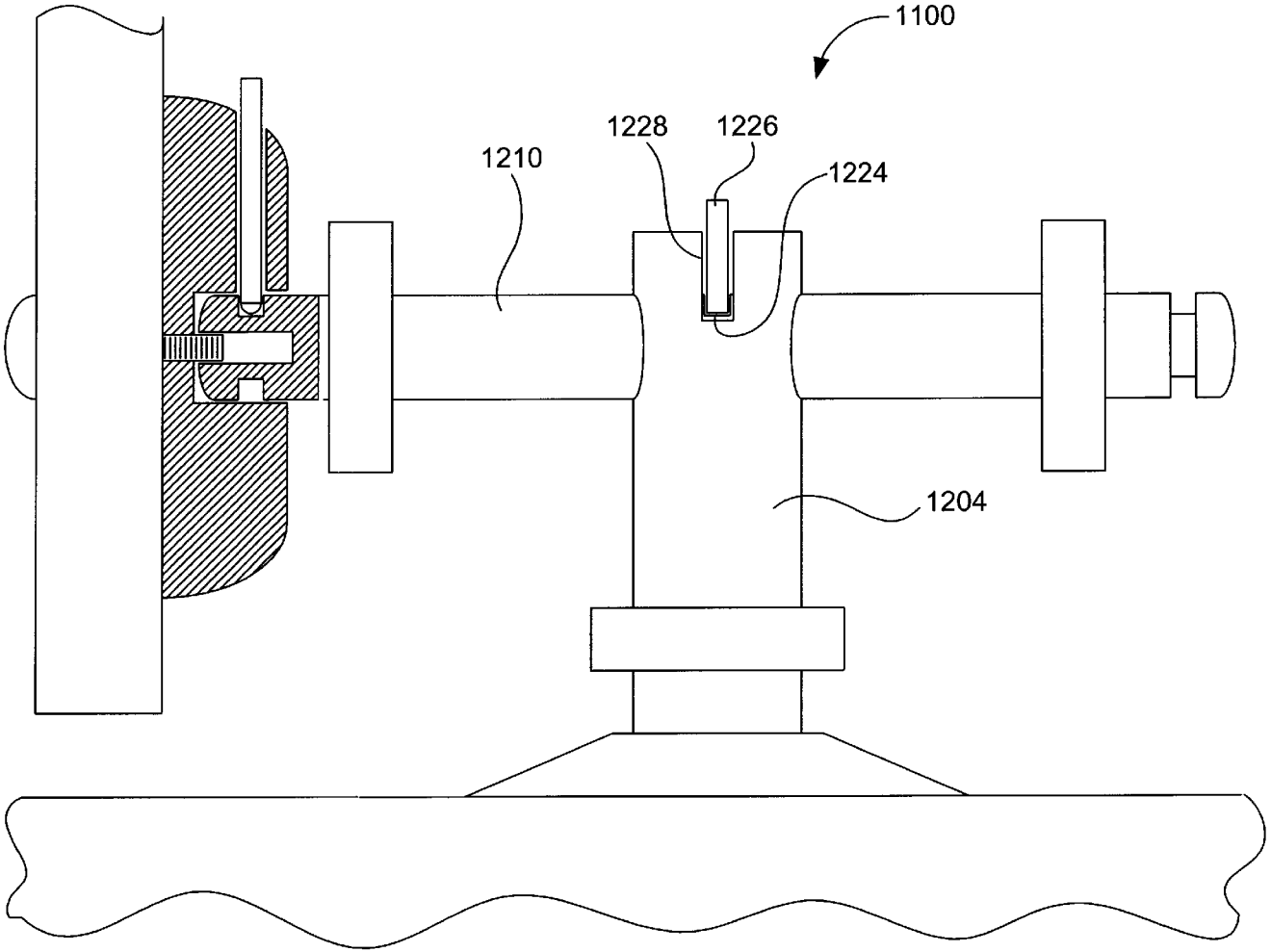
FIG. 15 depicts, in accordance with one embodiment of the present invention, a side view of the multi-positional ADS lock locking a door in the door shut position.

Referring to FIG. 15, a slot/stop plate arrangement is shown that prevents the locking member from sliding in either direction. Locking member 1210 includes a slot 1224 that is recessed along the perimeter of the locking member. Preferably, the depth of slot 1224 is configured to accept a portion of stop plate 1226. It should be noted that any portion of the locking member may be used to create the slot (e.g., a slot on one side of the locking member that may extend substantially to the center of the locking member). Correspondingly, stop plate 1226 is configured to fit into slot 1224. The stop plate may be formed from any shape so long as the shape coincides with a portion of the slot. Typically, the stop plate is formed from a material that can withstand the forces of an unwanted intruder (e.g., steel or hard polymer such as plastic).

Furthermore, body member 1204 includes a notch 1228 that is dimensioned to coincide with slot 1224. Notch 1228 is placed in an inner portion of body member 1204 and disposed at the end of the body member that is opposite the floor mounting end. When the slot and notch are aligned, slot plate 1226 may be disposed inside the slot/notch combination. Optionally, the slot plate may be coupled to the body member through a pivot point so that the plate may be easily positioned in the slot and notch. The pivot may be biased (e.g., spring) to automatically dispose the slot plate in the aligned slot/notch combination.

Still further, the slot may be disposed on the locking member in a plurality of locations. The slot may be configured in a location where the stop plate, rather than abutting to an interior portion of the body member (e.g., notch), abuts to the outer portion of the body member. Typically, this arrangement will only prevent locking member movement in one direction.

In a preferred embodiment of the present invention, the position of the slot on the locking member is predetermined as the door shut position (FIG. 11A). Generally, this position is used in doors that swing inward and/or outward or both. To implement this feature of the present invention, a multi-positional ADS lock user will close the door (e.g., door shut position) and secure the body member to the floor mounting plate. Once secured, the user will slide the locking member along the body member to engage the locking member binding end with the door binding portion of the door mounting plate (e.g., the binding pin engages the binding slot). At this point, the slot and notch should be aligned (e.g., predetermined for door shut position) and the user will place the stop plate into the slot/notch combination, thereby locking the door. If an intruder tries to pull or push the door open, the stop plate will abut to the body member, which will prevent the locking member from sliding. Because the locking member is coupled to the door mounting plate, the door will not move and the intruder will be prevented from gaining access.

Figure 16:
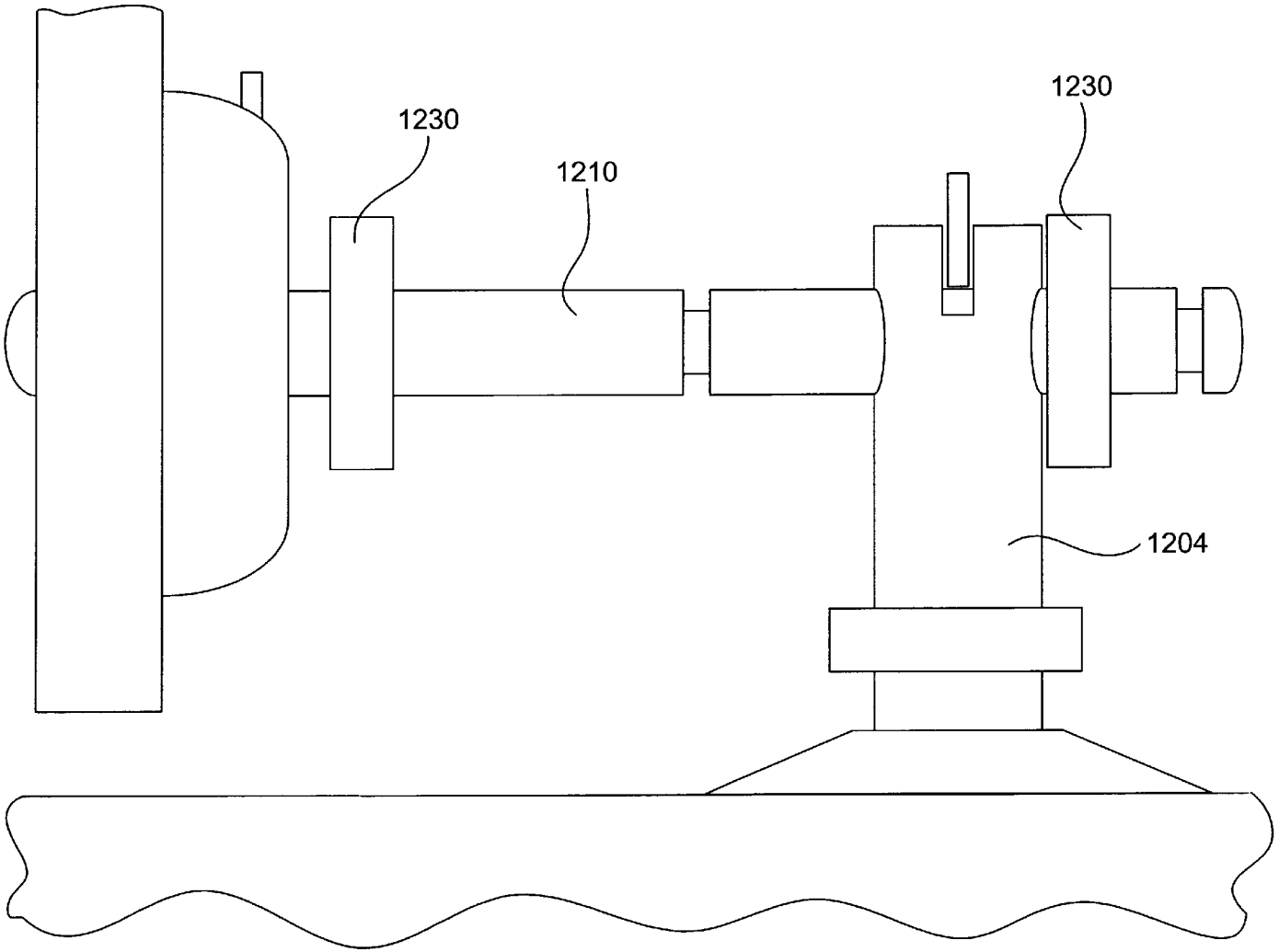
FIG. 16 shows, in accordance with one embodiment of the present invention, a side view of the multi-positional ADS lock preventing a door from moving in a direction away from the multi-positional ADS lock.

Referring to FIG. 16, a blocking portion stop arrangement is shown that prevents the locking member from sliding in one direction. In this embodiment, blocking portion 1230 is coupled to locking member 1210. Furthermore, blocking portion 1230 may be structurally coupled (i.e., set screw, weld, machined, etc) to the locking member at one predetermined position or be adjustable at several predetermined positions (i.e. a thread that coincides with a thread on the locking member, a pin that coincides with any number of apertures on the locking member, etc.).

Moreover, a portion of the outer perimeter of blocking portion 1230 is configured to extend away from the outer perimeter of the locking member. The blocking portion may take on any shape, and may include screws, pins and the like. Preferably, the blocking portion has a circular cross section that has an outer perimeter that is larger than the outer perimeter of the locking member. In this manner, blocking portion 1230 will stop the movement of the locking member when blocking portion 1230 comes into contact with the outer surface of the body member (as shown). Preferably, the blocking portion is formed from a material that can withstand the forces of an unwanted intruder (e.g., steel or hard polymer such as plastic). Optionally, a deformable gasket may be disposed around the locking member between the blocking portion and the body member to reduce wear that is developed by the contacting surfaces of the body member and blocking portion.

In a preferred embodiment of the present invention, the position of the blocking portion 1230 on the locking member is predetermined as the door partially open position away from the multi-positional ADS lock (FIG. 11B). Generally, this position is used in doors that swing outward to prevent a door from being pulled open by an intruder. Preferably, the blocking portion position allows the door to be opened about 2 inches to 3 inches. It should be noted that the stop arrangement used for the partially open position in a direction away from the ADS lock is not limited to the use of the blocking portion and that any suitable stop arrangements may be used (e.g., slot/slot plate).

To implement the previously described embodiment, a multi-positional ADS lock user will close the door (e.g., door shut position) and secure the body member to the floor mounting plate. Once secured, the user will slide the locking member to engage the locking member binding end with the door binding portion of the door mounting plate (e.g., the binding pin engages the binding slot). At this point, the door may be opened until the blocking portion abuts to the body member. Basically, the blocking portion limits how far the door may be opened. If an intruder tries to pull the door open, the blocking portion will abut to the body member thereby preventing the locking member from sliding. Because the locking member is coupled to the door mounting plate, the door will not move and the intruder will be prevented from gaining access.

Although the stop arrangements (FIGS. 14 and 15) are described as a slot/stop plate or a blocking portion, many other types of stopping arrangements may used that can prevent the lateral movement of the locking member (e.g., aperture and pin). Also, the present invention is not limited to only one slot or one blocking portion and that a multiplicity of slots and blocking portions may be used, especially if many stopping positions are desired.

Furthermore, the multi-positional ADS lock includes a blocking arrangement that is configured to prevent a door from opening in a direction towards the multi-positional ADS lock. In this embodiment, at least two blocking elements are configured to abut to a portion of the door when the locking member is parallel to the door to block the door from moving past the multi-positional ADS lock. It should be noted that the blocking portion that was previously described in the stop arrangement is also advantageously used as the blocking element in this embodiment, however, this is not a requirement.

Figure 17:
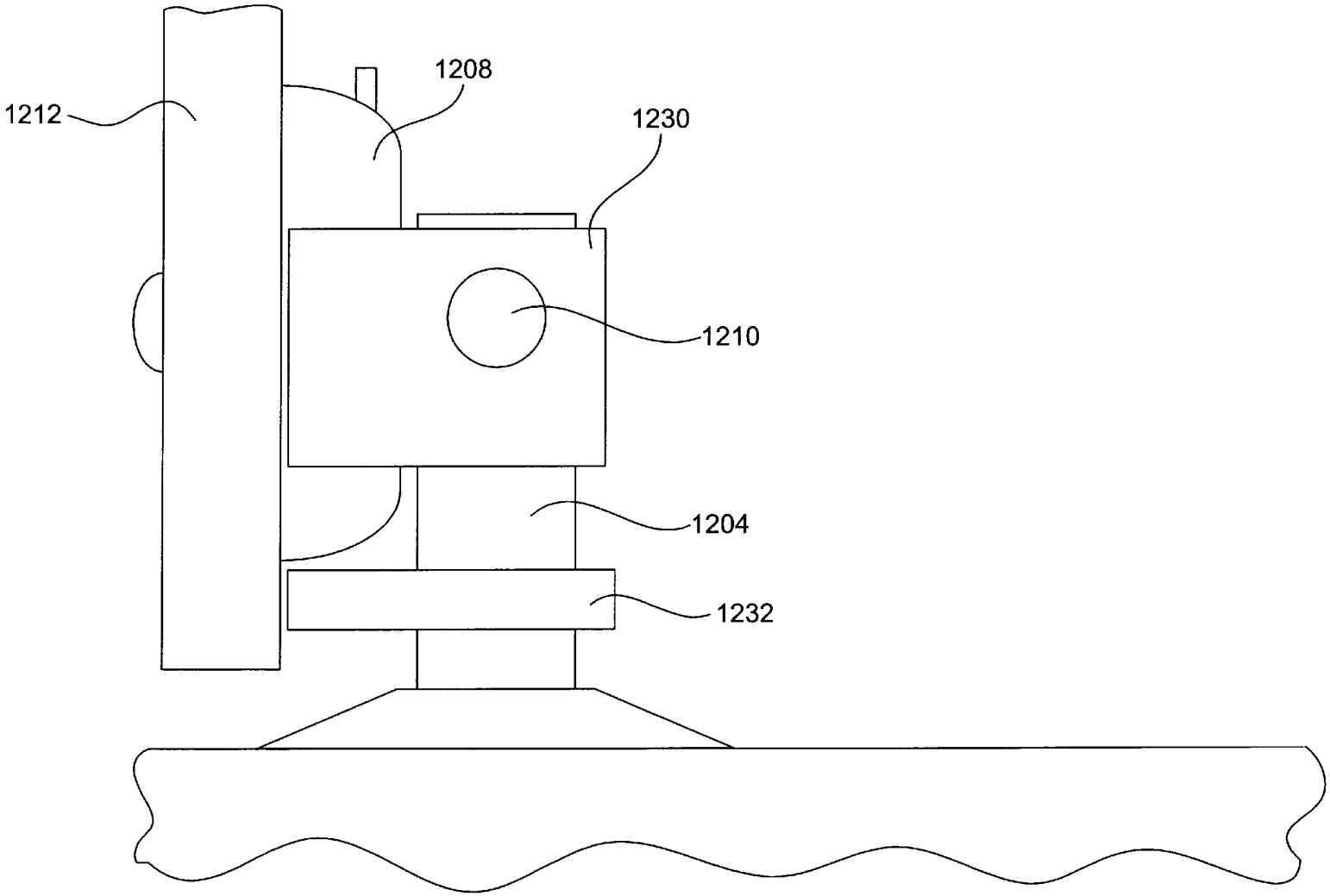
FIG. 17 depicts, in accordance with one embodiment of the present invention, a side view of the multi-positional ADS lock blocking a door from moving in a direction towards the multi-positional ADS lock.

To facilitate discussion of this aspect of the present invention, FIG. 17 shows a blocking element 1230 (same as blocking portion 1230) that is configured to abut to door 1212 when door 1212 is partially opened and when locking member 1210 is substantially parallel to door 1212. Although not shown, two substantially similar blocking elements are used to block the door. In this arrangement, the blocking elements are coupled to the locking member just inside the locking member binding ends (as shown in FIG. 12A). However, the blocking element position with respect to the locking member is typically determined by the blocking portion position of the previously described stop arrangement. Preferably, the blocking elements are dimensioned to prevent contact between the body member and the door mounting plate. The blocking elements may be formed from any geometrical shape (i.e., cylindrical, spherical, rectangular, cubical, triangular, polygonal, etc.) so long as they have a substantial outer periphery that contacts the door. Preferably, the blocking portions are formed from a material that can withstand the forces of an unwanted intruder (e.g., steel or hard polymer such as plastic). Alternatively, it may be desirable to include a soft deformable material (e.g., rubber or plastic) around the outer periphery of the blocking portions to prevent damage to the door.

Alternatively, a body member blocking element 1232 is coupled to the body member. Preferably, body member blocking element 1232 is configured similarly to the shape and dimensions of the previously described blocking elements. The body member blocking element is used in combination with the two blocking elements to create three contact points between the multi-positional ADS lock and the door. As is well known in the art, three points define a plane and therefore it is preferable to have three points of contact to prevent door movement. However, it should be noted that the multi-positional ADS lock is not limited to three contact points and any arrangement of contact points that prevent the movement of a door may be used.

In a preferred embodiment of the present invention, the location of the multi-positional ADS lock on the floor is predetermined as the door partially open position towards the multi-positional ADS lock (FIG. 11D). Generally, this position is used in doors that swing inward to prevent a door from being pushed open by an intruder. Preferably, the multi-positional ADS lock position allows the door to be opened about 2 inches to 3 inches. Alternatively, it should be known that this position may be achieved using the implementation as shown in FIG. 11C.

To implement the previously described embodiment, a multi-positional ADS lock user will close the door (e.g., door shut position) and secure the body member to the floor mounting plate. Once secured, the user will rotate the body member so that the locking member is parallel to the door. The user will then lock the locking member in place using the stop plate. At this point, the door may be opened until the two blocking portions and the body member blocking portion abut to the door. Basically, the position of the ADS lock with respect to the door limits how far the door may be opened. If an intruder tries to push the door open, the blocking portion will abut to the door thereby preventing the door from opening any further. Because the body member is coupled to the floor mounting plate, the door will not move and the intruder will be prevented from gaining access.

In an alternate embodiment, the collar as shown in 13A&B is substantially similar in dimension as blocking portion 1230, so that when body member 1204 is rotated into the blocking position the door abuts to the outer periphery of collar 1310 and blocking portions 1230 thereby preventing any further inward movement by door 1212. However, the extension of the door binding portion may impede the blocking structure of the multi-positional ADS lock in this embodiment. Therefore, the door binding portion may be configured to be movable. Several examples include: removing the door binding portion from the door mounting plate, sliding the door mounting plate to a position that wont impede, or placing the door binding portion on a pivot. In the pivot example, the extension is moved to a position that is substantially flush with the door mounting plate, thereby moving it out of the way.

Figure 18:
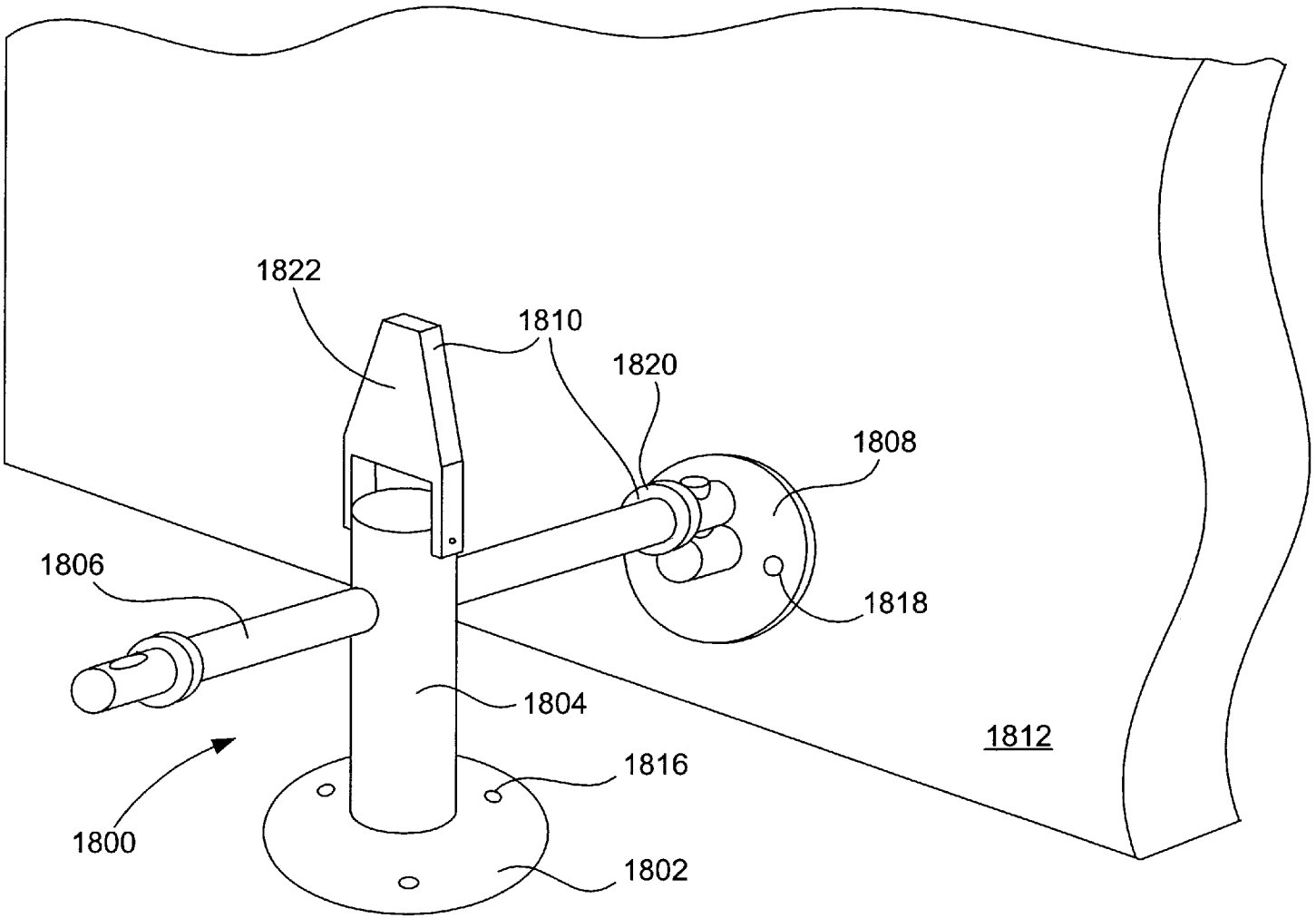
FIG. 18 shows a perspective view of a multi-positional ADS lock, in accordance with another embodiment of the present invention.

Referring next to FIG. 18, there is shown a multi-positional ADS lock 1800 in accordance with another preferred embodiment of the present invention. The multi-positional ADS lock 1800 includes a floor mounting plate 1802, a body member 1804, a locking member 1806, a door mounting plate 1808 and a stop arrangement 1810. In this figure, the multi-positional lock is provided in accordance with the teachings of the invention set fourth above with regards to FIGS. 11A–11D. That is, the multi-positional lock 1800 shown in FIG. 18 may work with both inward and outward swinging doors. As shown, the body member 1804 is supported vertically in front of a door 1812, and locking member 1806 is disposed substantially perpendicular to the body member 1804. In this embodiment, the locking member 1806 is slidably coupled to the body member 1804, and configured to have a plurality of locking positions that will lock the door when the door is shut, when the door is partially open away from the multi-positional ADS lock or when the door is partially open towards the multi-positional ADS lock.

In order for the multi-positional ADS lock 1800 to secure a door 1812, the multi-positional ADS lock 1800 is typically secured to a floor 1814 and the door 1812. In most cases, this is accomplished by coupling the body member 1804 to the floor mounting plate 1802, which is structurally attached to the floor 1814 using mechanical screws or an adhesive, and coupling the locking member 1806 to the door mounting plate 1808, which is structurally attached to the door 1812 using mechanical bolts or screws. The floor mounting plate 1802 and the door mounting plate 1808 will be described in greater detail below.

Furthermore, the stop arrangement 1810 is configured to hold the locking member 1806 in at least one predetermined position relative to the body member 1804. Correspondingly, the door 1812 is prevented from moving past a predefined door position (e.g., door shut or door partially open). In a preferred embodiment, the stop arrangement 1810 includes a stop ridge 1820 and a stop plate 1822 that are configured to prevent the locking member 1806 from moving. In one implementation, the stop ridge and the stop plate cooperate to prevent locking member movement, and in another implementation, the stop ridge cooperates with the body member to prevent locking member movement. Further, the stop plate 1822 is pivotly coupled to the body member 1804, and the stop ridge 1820 is structurally coupled to the locking member 1806.

Referring to FIGS. 19A–19D, a side view of the multi-positional ADS lock 1800 is shown in multiple locking positions. In all four figures, the multi-positional ADS lock is secured to the floor 1814, through the floor mounting plate 1802 and to the door 1812, through door mounting plate 1808. Door 1812 typically includes a pivot point (not shown) that enables the door to swing along an outside path 1902 or an inside path 1904. The outside path 1902 is generally in a direction away from the multi-positional ADS lock 1800, and the inside path 1904 is generally in a direction towards the multi-positional ADS lock 1800.

Figure 19A:
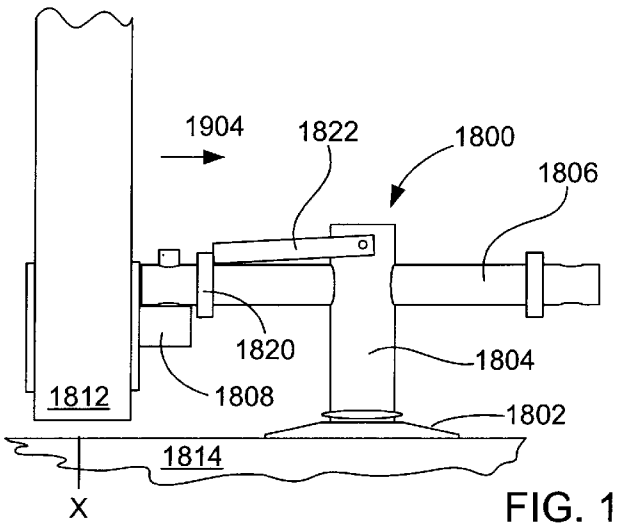
FIGS. 19A–19D are side views of the locking positions associated with the multi-positional lock shown in FIG. 18, in accordance with several embodiments of the present invention.

In FIG. 19A, the multi-positional ADS lock 1800 is configured to prevent the door 1812 from swinging along the inside path 1904. Ideally, this arrangement locks the door 1812 in a door shut position X, wherein the door cannot be pushed open (e.g., inward swinging doors). As shown, the stop plate 1822 is lowered towards the door so that the stop plate 1822 is in contact with and abutted against the stop ridge 1820. By placing the stop plate 1822 in this position the locking member 1806 is prevented from moving in a direction away from the door 1812, and thus the door is prevented from opening in a direction towards the body member 1804.

Figure 19B:
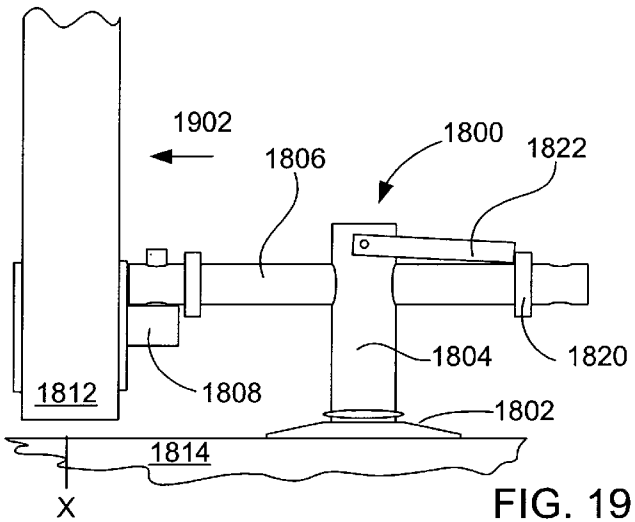

In FIG. 19B, the multi-positional ADS lock 1800 is configured to prevent the door 1812 from swinging along the outside path 1902. Ideally, this arrangement locks the door 1812 in the door shut position X, wherein the door cannot be pulled open (e.g., outward swinging doors). As shown, the stop plate 1822 is lowered away from the door such that the stop plate 1822 is in contact with and abutted against the stop ridge 1820. By placing the stop plate 1822 in this position the locking member 1806 is prevented from moving in a direction towards the door 1812, and thus the door is prevented from opening in a direction away from the body member 1804.

Figure 19C:
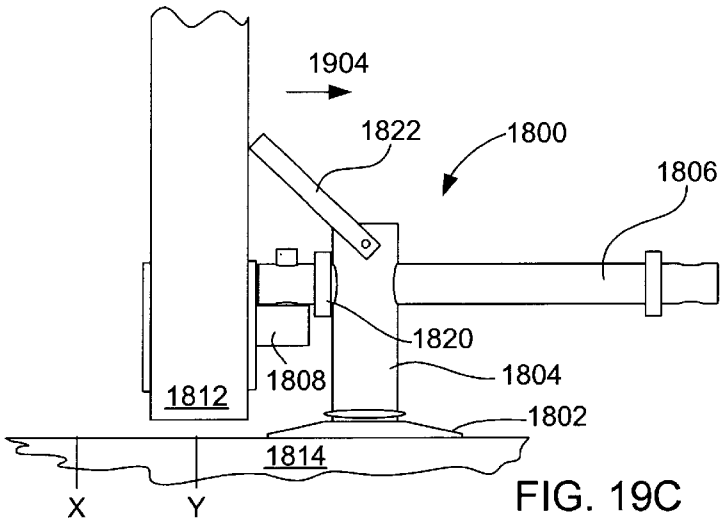

In FIG. 19C, the multi-positional ADS lock is configured to prevent the door 1812 from swinging along the inside path 1904 after the door 1812 has moved a predefined distance. That is, the door cannot be pushed past a predefined door position Y. Ideally, this arrangement provides a small opening between the door 1812 and the door frame (not shown) wherein select items may be passed from one side of the door to the other or the identity of a person standing outside the door may be ascertained. As shown, the stop plate 1822 is not used, but rather the stop ridge 1820 is in contact with and abutted against the body member 1804. In this manner, the locking member is prevented from moving in a direction away from the door, and therefore the door is prevented from opening past predefined door position Y. In one implementation, the predefined door position Y is configured to allow the door to be opened about 2 to about 3 inches.

Figure 19D:
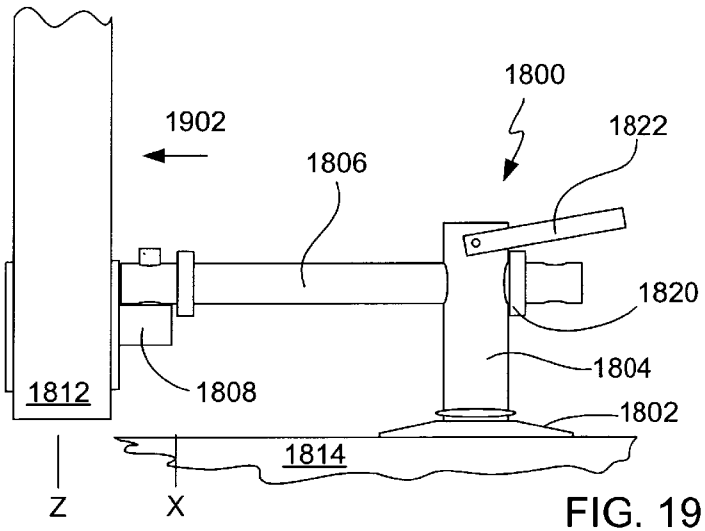

In FIG. 19D, the multi-positional ADS lock 1800 is configured to prevent the door 1812 from swinging along the outside path 1902 after the door 1812 has moved a predefined distance. That is, the door 1812 cannot be pulled past a predefined door position Z. Ideally, this arrangement provides a small opening between the door 1812 and the door frame (not shown) wherein select items may be passed from one side of the door to the other or the identity of a person standing outside the door may be ascertained. As shown, the stop plate 1822 is not used, but rather the stop ridge 1820 is in contact with and abutted against the body member 1804. In this manner, the locking member is prevented from moving in a direction towards the door, and therefore the door is prevented from opening past predefined door position Z. In one implementation, the predefined door position Z is configured to allow the door to be opened about 2 to about 3 inches.

Figure 20:
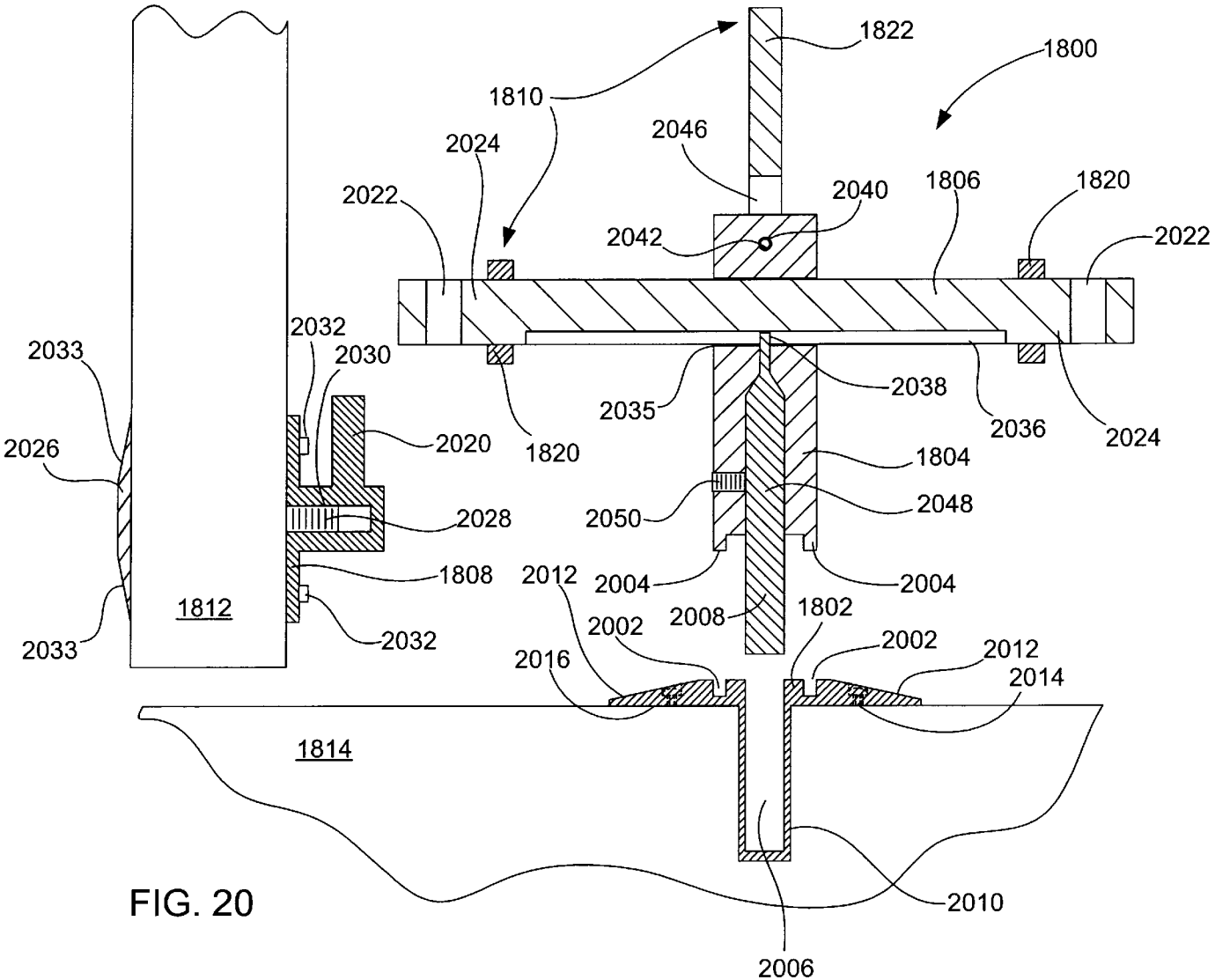
FIG. 20 is a side view, in cross section, of the multi-positional ADS lock shown in FIG. 18, in accordance with another embodiment of the present invention.
Figure 21:
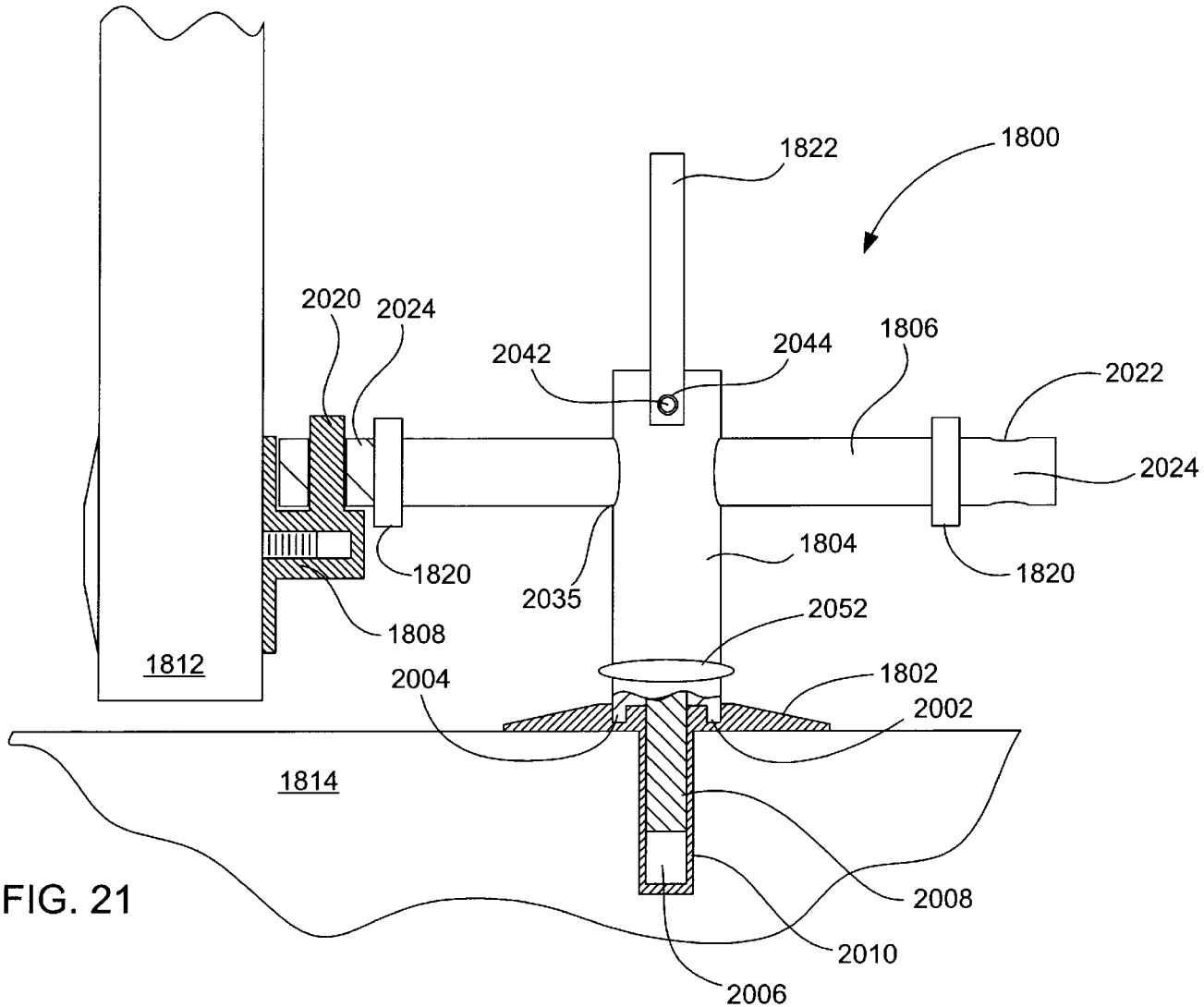
FIG. 21 is a side view, in partial cross section, of the multi-positional ADS lock in FIG. 18, in accordance with another embodiment of the present invention.

Referring next to FIGS. 20 & 21, cross sectional and partial cross sectional illustrations of the aforementioned multi-positional ADS lock 1800 will be described in detail. As mentioned, multi-positional ADS lock 1800 includes a floor mounting plate 1802, a body member 1804, a locking member 1806, a door mounting plate 1808 and a stop arrangement 1810. Preferably, each of these elements and their components parts (e.g., stop ridge, stop plate, etc.) are sized and formed to withstand the forces of an unwanted intruder. As is well known to those skilled in the art, the sizes involved may vary according to the specific material chosen. Further, the locking member, the body member and their component parts are preferably formed from a material that does not wear easily when contacting adjacent and moving surfaces. By way of example, steel or a hard polymer such as plastic work well. Additionally, it should be understood that the parts of presently described multi-positional ADS lock may be constructed similarly to the respective parts described in previous ADS lock arrangements.

Referring first to the floor mounting plate, the floor mounting plate 1802 is configured to support and securely hold the body member 1804 to the floor 1814. More specifically, the floor mounting plate 1802 is preferably configured to be mounted to the floor and include a first recess 2002 for receiving a first extension 2004 of the body member 1804, and a second recess 2006 for receiving a second extension 2008 of the body member 1804. The first and second recesses 2002, 2006 are configured to cooperate with the first and second extensions 2004, 2008, respectively, to prevent dislodgement of the body member 1804 from the floor mounting plate 1802. That is, when the first and second extensions 2004, 2008 of the body member 1804 are respectively disposed inside the first and second recesses 2002, 2006 of the floor mounting plate 1802, the body member 1804 is substantially immovable in a lateral direction.

To elaborate even further, the floor mounting plate 1802 includes a sleeve portion 2010 which may be embedded into an opening in the floor 1814 and which defines the second recess 2006. The second recess 2006 is also arranged to have a length that is arranged to further prevent dislodgement of the body member 1804 from the floor mounting plate 1802 when a force is exerted on the body member 1804. Further, the first recess 2002 is preferably a concentric groove that is disposed around the second recess 2006. Further still, the floor mounting plate 1802 may also have tapered edges 2012, which serve to create a smooth transition between the floor mounting plate 1802 and the floor 1814. Additionally, or alternatively, a deformable gasket may be disposed between the floor mounting plate and the floor to smooth out the coupling between the floor mounting plate and the floor.

Typically, a plurality of fasteners 2014, e.g., screws or the like, may be used to secure the floor mounting plate 1802 to the floor 1814. Correspondingly, the floor mounting plate 1802 preferably includes a plurality of mounting holes 2016 through which the fasteners 2014 may be disposed in the floor 1814. Additionally, the floor mounting plate may be attached to the floor using, for example, an appropriate adhesive. Moreover, it should be noted that the multi-positional ADS lock arrangement is not limited by the use of a floor mounting plate and that any means suitable for coupling the body member to the floor (e.g., hole in the floor whether or not reinforced with a sleeve) may be used so long as the body member is substantially immovable by a force exerted by an intruder pushing or pulling on a door (e.g., lateral direction).

In an alternate embodiment, in cases where an opening in the floor cannot be made, the floor mounting plate is arranged in accordance with the teachings of the invention set fourth above with regard to FIG. 7. However, in this embodiment, the floor mounting plate includes a permanent magnet that is used to further secure the body member to the floor mounting plate. The permanent magnet may generally be attached to either the floor mounting plate or the body member so that the permanent magnet is in contact with an opposing surface when the body member is coupled to the floor mounting plate.

Figure 22A:
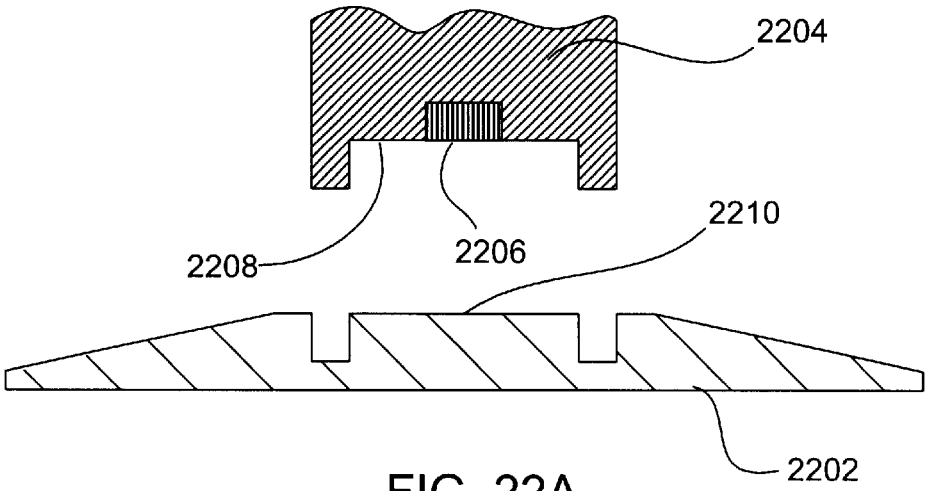
FIGS. 22A & 22B are a side views, in cross section, of a permanent magnet arrangement that is used to further secure a body member to a floor mounting plate.
Figure 22B:
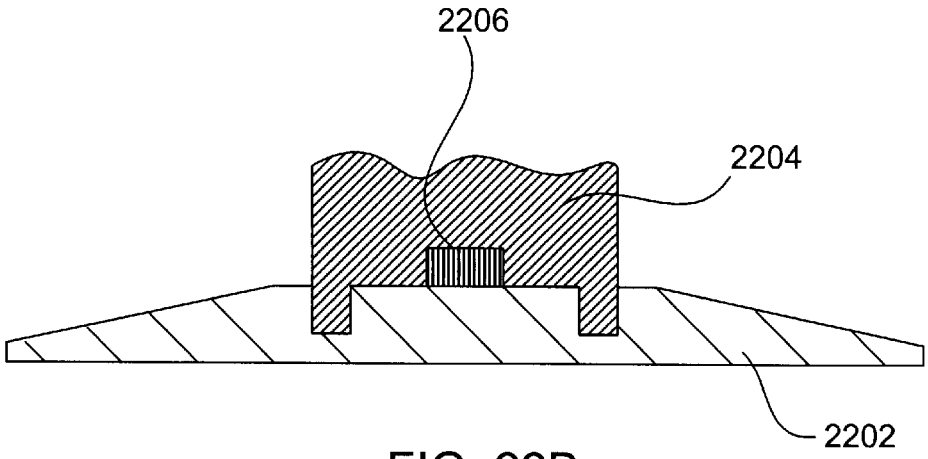

To facilitate discussion of this embodiment, FIGS. 22A & 22B show one implementation of a permanent magnet that is used to further secure the body member to the floor mounting plate. In this embodiment, a floor mounting plate 2202 is arranged such that substantially no portion of floor mounting plate 2202 penetrates the surface of the floor (not shown). Since substantially no portion of floor mounting plate 2202 penetrates the surface of the floor, floor mounting plate 2202 may be moved relatively easily to different surfaces, as portions of surfaces generally need not be bored out in order to receive portions of body member 2204.

In this embodiment, a permanent magnet 2206 is also disposed on a bottom surface 2208 of the body member 2204. The permanent is preferably configured to come into contact with a top surface 2210 of the floor mounting plate 2202 when the body member 2204 is seated in the floor mounting plate 2202. As a result, the body member and the floor mounting plate are biased together by the magnetic field of force produced by the permanent magnet 2206, and therefore the coupling is more secure and the body member is less likely to be forced out of the floor mounting plate. It should be understood that this embodiment is not limited to any particular surface or any particular floor mounting plate, and may be used with any of the floor mounting plates described in previous embodiments.

Additionally or alternatively, a magnetic mechanism may also be used to effectively attach the floor mounting plate to the floor or the locking member to the door mounting plate or even the door mounting plate to the door.

Referring now to the door mounting plate and back to FIGS. 20 & 21, the door mounting plate 1808 is configured to support and securely hold the locking member 1806 to the door 1812. The door mounting plate 1808 is configured to include a vertical protrusion 2020 that is configured to be received by a binding thru-hole 2022 disposed at a binding end 2024 of the locking member 1806. Generally, the binding thru-hole 2022 has a shape that coincides with the cross sectional shape of the vertical protrusion 2020. In one embodiment, the cross sectional shape is circular so that the binding thru-hole may pivot along the vertical protrusion. Accordingly, the coupling between the vertical protrusion 2020 and the binding thru-hole 2022 tends not to bind when the locking member 1806 is moved into its various positions. Additionally, both ends of the locking member 1806 are preferably arranged to have a binding thru-hole 2022. As a result, the locking member 1806 is substantially interchangeable and therefore, the locking member 1806 may be easily coupled to the door mounting plate 1808 from either side.

The door mounting plate 1808 is typically configured to be mounted to an interior portion of the door 1812 and arranged to extend perpendicularly therefrom. Further, an exterior mounting plate 2026 having a threaded extension 2028 is used to secure the door mounting plate 1808 to the door 1812. Correspondingly, the door mounting plate 1808 includes a threaded portion 2030 that is configured for accepting the threaded extension 2028. Therefore, in order to couple the exterior mounting plate 2026 to the door mounting plate 1808, the threaded extension 2028 of the exterior mounting plate 2026 is inserted through an aperture (not shown) in the door 1812 and attached to the threaded portion 2030 of the door mounting plate 1808. Advantageously, the exterior mounting plate 2026 prevents an outside intruder from removing the multi-positional ADS lock 1800 by placing the securing means (e.g., threaded potion) inside the door 1812.

Additionally or alternatively, the door mounting plate 1808 may be attached to the door 1812 with a plurality of screws 2032 that pass through mounting holes (not shown) disposed inside the door mounting plate 1808, and into door 1812 such that the screws 2032 are completely inaccessible from outside the door. Although only fasteners have been described for securing the door mounting plate to the door, it should understood that other types of securing means may be used, for example, some types of adhesives work well.

Additionally or alternatively, the exterior mounting plate may be configured without edges so that an outside intruder will not be able to grasp it. In one implementation, the exterior mounting plate 2026 has a taper 2033, thereby eliminating the edges. Further, a deformable gasket may be disposed between the door mounting plate and the door to smooth out the coupling between the door mounting plate and the door.

Referring now to the locking member, the locking member 1806 is slidably coupled to the body member 1804 by means of a body member thru-hole 2035 in the body member 1804 in which the locking member 1806 is disposed. The body member thru-hole 2035 should be large enough to accommodate the locking member 1806 and provide enough clearance to allow the locking member 1806 to slide through the body member thru-hole 2035 about its centerline. Further, the locking member 1806 includes a sliding groove 2036 that is configured to cooperate with a sliding nub 2038 that extends from the body member 1804 inside the body member thru-hole 2035. In this manner, the locking member 1806 is mechanically constrained to linear motion, and therefore, the locking member tends to retain its position so that the binding thru-hole may be easily aligned with the vertical protrusion of the door mounting plate.

Additionally, a pair of stop ridges 1820 are structurally coupled to the locking member 1806. The stop ridges 1820 may be coupled to the locking member 1806 in any suitable manner such as soldering, welding, adhesives, fasteners and the like. Alternatively, the stop ridge can be formed from the locking member itself (e.g., machined). Further, the stop ridges may take on any shape, and may include screws, pins and the like. In one implementation, the stop ridge has a circular cross section that has an outer perimeter that is larger than the outer perimeter of the locking member. For the most part, the stop ridges 1820 are arranged to constrain the sliding of the locking member 1806 within a fixed range. That is, the stop ridges 1820 are preferably configured to be larger than the body member thru-hole 2035 and to extend out of the locking member so that the locking member 1806 is prevented from sliding when one of the stop ridges 1820 abuts to an outer portion of the body member 1804 or the stop plate 1822.

The position of the stop ridges along the locking member generally determines the distance a door may be opened when the multi-positional ADS lock is engaged. Therefore, the stop ridges are preferably arranged along the locking member so that a door may be opened between about 2 to about 3 inches. It has been determined that 2 to 3 inches provides a small enough opening wherein select items may be passed from one side of the door to the other or the identity of a person standing outside the door may be ascertained without allowing a space for an intruder to gain entry or access to the multi-positional ADS lock. However, it should be noted that the above mentioned dimension is not a limitation and that the size of the opening may vary according to the specific needs of each multi-positional ADS lock user. In one implementation, the stop ridges 1820 are disposed near the binding thru-holes 2022 and the binding end 2024.

Referring now to the stop plate, the stop plate 1822 is pivotly coupled to the body member 1804 by means of a pivot hole 2040 in the body member 1804, and a pivot pin 2042 that is structurally disposed inside the pivot hole 2040. The pivot pin 2042 is configured to extend past the body member 1804 and through a pivot thru-hole 2044 in the stop plate. The pivot thru-hole 2044 should be large enough to accommodate the pivot pin 2042 and provide enough clearance to allow the stop plate 1822 to rotate about its centerline. It should be understood that pivot pin arrangement is not a limitation and that any suitable pivoting arrangement may be used. Furthermore, the stop plate 1822 preferably includes a cut away portion 2046 to allow movement around the body member 1804. As mentioned, the stop plate 1822 is configured to abut to a portion of the stop ridge 1820 to prevent the locking member 1806 from sliding relative to the body member 1804.

Referring now to the body member, the body member 1804, includes an extension pin 2048 that is inserted through a cavity in the body member 1804. The extension pin is generally attached to the body member with a set screw

2050. However, it should be understood that any suitable attaching means may be used, for example, soldering, welding, threading, adhesives, fasteners and the like. Alternatively, the extension pin may be left uncoupled if sized appropriately.

In the embodiment shown, the extension pin has a proximal and distal end, which respectively correspond to the sliding nub 2038 and the second extension 2008. Correspondingly, the cavity of the body member 1804 includes an opening (not shown) that allows the sliding nub to mate with the sliding groove 2036 of the locking member 1806. However, it should be noted that the extension pin is not a limitation of the present invention, for example, the sliding pin and second extension may be integrally formed from the body member itself. Moreover, an o-ring or gasket 2052 is typically disposed around the body member near the location of the set screw to both cover the set screw and provide a deformable surface that may protect a door if the ADS lock is hung on the door when not in use.

Furthermore, while most of the component parts of the multi-positional ADS lock have been generally shown and described as having a substantially circular shape, it will be appreciated that the shape of the component parts (e.g. floor mounting plate, door mounting plate, body member, locking member, etc.) may be widely varied. For instance, alternate shapes may include, but are not limited to, elliptical, rectangular, and polygonal shapes. Similarly, the shape of the protrusion and the channel of a base plate or floor mounting plate may also vary, and are not necessarily substantially circular.

Accordingly, the present invention offers numerous advantages over existing door locking mechanisms. Advantageously, the multi-positional ADS lock is placed within the confines of the interior part of the door. In this manner, an intruder cannot disengage the locking mechanism to gain entry, or even attempt to cut through, although this would be difficult even if seen by the intruder. Additionally, because the lock is placed behind the door, the multi-positional ADS lock user does not have to offend non-intruders with a showing of the lock. Moreover, the multi-positional ADS lock cannot be picked, like some dead bolt lock arrangements.

Further, the floor is more secure than a door frame, which under extreme force of an intruder may buckle or break. Typically, they are screwed into the doorjamb. If an intruder uses enough force the screws holding the lock may be stripped from the doorjamb or the doorjamb itself may be disengaged from the wall. Further still, the multi-positional ADS lock provides a user, multiple positions for preventing a door from being moved. Simply put, one design may be used on all swinging doors, whether they open in or out. Additionally, because of the advantageous design, the invention is simple to use (e.g., lock, unlock, engage, disengage, etc.) and provides aesthetic choices to the user. By way of example, the stop ridge and stop plate combination or the slot and stop plate combination used for the door shut position provides easy control for accessing other stop positions (e.g., the user only has to manipulate the stop plate).

Although only a few embodiments of the present inventions have been described in detail, it should be understood that the present inventions may be embodied in many other specific forms without departing from the spirit or scope of the inventions. For example, although only two configurations of the blocking member have been disclosed, it should be clear that many other configurations may be embodied without departing from the spirit or the scope of the invention. Some possible configurations include, but are not limited to, configurations in which the blocking member is Y-shaped and configurations in which the blocking member is simply a single bar, e.g., without lock arm 604, or a plate.

While a non-intrusive base plate such as base plate 700 of FIG. 7 has been described as being suitable for use with an ADS lock, a non-intrusive base plate may be used with a variety of different door security locks without departing from the spirit or the scope of the present invention. In some cases, modifications may be made to the locks themselves to enable the locks to be supported on such a base plate.

Although a groove, or channel, formed around the protrusion of a base plate that supports a post has been described as being "continuous," e.g., uniform and smooth, it should be appreciated that in some embodiments, the groove may be discontinuous. In other words, the groove itself may include protrusions that engage corresponding cavities of a post in order to further secure the ADS lock.

Moreover, in some embodiments of the present invention, it may be desirable to incorporate the use of roller bearings with the blocking or locking member to extend the life of the ADS lock. Similarly, the use of a bearing surface, as for example a coating of Teflon™, may be implemented in place of an actual mechanical bearing.

Furthermore, it may be desirable to alter the combination of the door mounting plate, locking member and body member to form a new configuration that performs relatively the same function. In one such embodiment, one end of the locking member is permanently coupled to the door mounting plate and the other end includes a locking member binding end. Furthermore, the body member is configured with a body binding portion that is arranged to temporarily couple the locking member binding end to the body member. When the body binding portion and the locking member binding end are engaged, the door is prevented from moving past one of the predefined door positions previously described. In one embodiment, the locking member is pivotally coupled to the door mounting plate and therefore engages the body member by rotating about the pivot point (e.g., top to bottom or side to side).

Additionally, although the multi-positional ADS lock has been primarily discussed as a rigid member, it should be noted that the locking member may be a cable. In view of this, the locking member binding end may be a loop of cable that engages a lip at the corresponding binding portion or may be something similar (although modified) to what has been previously discussed (e.g., slot/pin, nub/nub aperture/collar). Also, the locking member may have multiple pivots or a telescoping arrangement in order to movably couple to the door.

Additionally, the inventions have been described in terms of a lock with predetermined and set positions, however, it should be appreciated that the described multi-positional ADS lock may be made adjustable. By way of example, the described stop ridges and stop plates (shown in FIGS. 18–21) may be configured to be adjustable to give the multi-positional ADS lock user more flexibility when installing the multi-positional ADS lock. Furthermore, although the invention has been described and shown as having only two stop ridges, it should be appreciated that a single or multiple stop ridges may be used. For example, one stop ridge may be used to cooperate with the body member and another stop ridge may be used to cooperate with the stop plate.

Therefore, the present examples are to be considered as illustrative and not restrictive, and the invention is not to be limited to the details given herein, but may be modified within the scope of the invention.

What is claimed is:

1. A home security kit for preventing opening movements of a door relative to a floor, the home security kit comprising:

a locking assembly that is installed and removed as a unit, the locking assembly comprising:

a body member configured to provide a secure and removable connection with said floor;

a locking member movably coupled to said body member, and having a temporary connection means for removably interlocking with said door; and a stop arrangement configured to prevent movement of said locking member relative to said body member so as to prevent said door from moving past a predefined door position when said body member is secured to said floor and when said locking member is interlocked with said door.

2. The home security kit of claim 1 further including a floor mounting plate configured to be mounted to said floor, said floor mounting plate providing a link between said floor and said locking assembly.

3. The home security kit of claim 2 wherein said body member includes a permanent magnet to further secure said body member to said floor mounting plate.

4. The home security kit of claim 1 further including a door mounting plate configured to be mounted to said door, said door mounting plate providing a link between said door and said locking assembly.

5. The home security kit of claim 4 wherein said locking member and said door mounting plate have cooperating connection elements for allowing a removable connection between said locking member and said door mounting plate.

6. The home security kit of claim 5 wherein the door mounting plate includes a door binding portion comprising an opening configured to receive an end of the locking member and a cavity for holding a pin therein, the pin being configured for insertion into a slot in the end of the locking member, wherein the locking member is effectively connected to the door mounting plate when the pin is inserted in the slot and effectively disconnected from the door mounting plate when the pin is removed from the slot.

7. The home security kit of claim 5 wherein the door mounting plate includes a door binding portion comprising an extension having a nub aperture for mating with a nub located on the end of the locking member, wherein the locking member is effectively connected to the door mounting plate when the nub is disposed inside the nub aperture.

8. The home security kit of claim 7 wherein the binding portion further includes a collar slidably coupled to the locking member, the collar being configured to slide over at least a portion of the nub and nub aperture when mated to prevent the nub from disengaging from the nub aperture.

9. The home security kit of claim 5 wherein the door mounting plate includes a door binding portion comprising a notch guide having a mating opening and a notch, the mating opening being configured to accept the cross sectional shape of a mating head located at the end of the locking member, the notch being configured to accept the cross sectional shape of a neck located at the end of the locking member proximal of the mating head.

10. The home security kit of claim 5 wherein the door mounting plate includes a door binding portion comprising a protrusion that is configured for receiving a thru-hole disposed at an end of the locking member.

11. The home security kit of claim 1 wherein the body member has a longitudinal axis and wherein said locking member has a longitudinal axis that traverses the longitudinal axis of said body member during coupling thereof.

12. The home security kit of claim 11 wherein the longitudinal axis of said locking member intersects the longitudinal axis of said body member during coupling thereof.

13. The home security kit of claim 11 wherein the longitudinal axis of said locking member is perpendicular to the longitudinal axis of said body member.

14. The home security kit of claim 1 wherein the stop arrangement is configured to hold the locking member in a predetermined position.

15. The home security kit of claim 14 wherein the stop arrangement comprises a stop plate that is adapted to be disposed inside a slot located on the locking member, the stop plate being configured to abut with a portion of the body member when the stop plate is disposed in the slot such that the locking member is prevented from moving relative to the body member.

16. The home security kit of claim 1 wherein the stop arrangement comprises a stop ridge that is structurally coupled to the locking member, the stop ridge extending outwardly in a direction away from the outer periphery of the locking member.

17. The home security kit of claim 16 wherein the stop ridge is configured to abut with a portion of the body member so as to prevent the locking member from moving relative to the body member.

18. The home security kit of claim 16 wherein the stop ridge is proximately positioned towards a distal end of the locking member.

19. The home security kit of claim 16 wherein the stop arrangement further comprises a stop plate that is movably coupled to an end of the body member, the stop plate being configured to abut with the stop ridge so as to temporarily prevent the locking member from moving relative to the body member.

20. The home security kit of claim 1 wherein the locking member is slidably coupled the body member.

21. The home security kit of claim 20 wherein the body member includes a thru hole, and wherein the locking member is disposed within the thru hole so as to allow linear movements.

22. The home security kit of claim 20 wherein the stop arrangement includes a plurality of stopping means which prevent linear movements of the locking member relative to the body member, each of the stopping means defining a separate linear position of the locking member relative to the body member.

23. The home security kit as recited in claim 1 wherein the movement of the locking member relative to the body member is constrained to linear motion.

24. An apparatus for holding a swinging door, comprising:

a door mounting plate configured to be mounted to said door;

a floor mounting plate configured to be mounted to a floor;

a body member having a means for removably interlocking with said floor mounting plate;

a locking member slidably coupled to said body member, and having a means for removably interlocking with said door mounting plate; and a stop arrangement configured to hold said locking member in at least one predetermined position relative to said body member, wherein when said door mounting plate is mounted to said door, said floor mounting plate is mounted to said floor, said body member is interlocked with said floor mounting plate, said locking member is interlocked with said door mounting plate, and said stop arrangement is holding said locking member, then said door is prevented from moving in at least one direction.

25. The apparatus of claim 24 wherein said first predefined door position is a door shut position.

26. The apparatus as recited in claim 25 wherein said second predefined door position forms an opening that is about 2 to about 3 inches.

27. The apparatus as recited in claim 24 wherein said floor mounting plate includes a first recess for receiving a first extension of said body member and a second recess for receiving a second extension of said body member such that said body member is coupled to said floor when said extensions are disposed in said recesses.

28. The apparatus as recited in claim 24 where said body member when coupled to said floor mounting plate is substantially immovable by a force exerted by said door.

29. The apparatus as recited in claim 24 wherein said body member has a thru-hole and a sliding nub therein, said locking member being configured to slide through said thru-hole of said body member, said locking member including a sliding groove that is configured to mate with said sliding nub when said locking member is disposed in said thru-hole of said body member.

30. The apparatus as recited in claim 24 wherein said door mounting plate includes a protrusion, and said locking member includes a binding thru-hole at said end, said binding thru-hole being configured to accept said protrusion to substantially couple said locking member to said door mounting plate.

31. The apparatus as recited in claim 24 wherein said body member includes a permanent magnet to further secure said body member to said floor mounting plate.

32. The apparatus as recited in claim 24 wherein said stop arrangement comprises:

a stop ridge coupled to said locking member, and arranged to engage a portion of said body member, said stop ridge and said body member being configured to cooperate to prevent said locking member from sliding past said predetermined position when said stop ridge is engaged with said body member.

33. An apparatus for preventing a door from being forcibly opened from either a first predefined position or a second predefined position, said door being opened further in said second predefined position than in said first predefined position, said apparatus comprising:

a door mounting plate configured to be mounted to said door;

a body member configured to provide a secure and removable connection with a floor;

a locking member slidably coupled to said body member, and having a means for removably interlocking with said door mounting plate; and a stop arrangement configured to hold said locking member in either a first predetermined position or a second predetermined position relative to said body member, wherein when said door mounting plate is mounted to said door, said body member is secured to the floor, said locking member is coupled to said door mounting plate, and said stop arrangement is holding said locking member in said first predetermined position, then said door is prevented from moving past said first predefined position, and wherein when said door mounting plate is mounted to said door, said body member is secured to the floor, said locking member is coupled to said door mounting plate, and said stop arrangement is holding said locking member in said second predetermined position, then said door is prevented from moving past said second predefined position.

34. The apparatus as recited in claim 33 wherein said stop arrangement further comprises:

a stop ridge coupled to said locking member, and arranged to engage a portion of said body member; and a stop plate pivotally coupled to said body member, and arranged to engage a portion of said stop ridge, said stop ridge and said stop plate being configured to cooperate to prevent said locking member from sliding past said first predetermined position when said stop plate is engaged with said stop ridge, said stop ridge and said body member being configured to cooperate to prevent said locking member from sliding past said second predetermined position when said stop ridge is engaged with said body member.

35. The apparatus as recited in claim 33 further comprising a floor mounting plate configured to be mounted to a floor, said body member having a means for removably interlocking with said floor mounting plate.

36. A locking system for holding a door relative to a floor, comprising:

a door mount adapted to be fixed to the door, the door mount having a binding portion;

a floor mount adapted to be fixed to the floor, the floor mount having a coupling portion;

a locking assembly that is installed and removed as a unit, the locking assembly comprising:

a body member having a coupling end adapted to be removably interlocked with the coupling portion of the floor mount in order to securely and removably link the body member to the floor mount; and a locking member coupled to the body member and having at least one binding end adapted to be removably interlocked with the binding portion of the door mount in order to securely and removably link the locking member to the door mount, wherein the body member has a longitudinal axis and wherein said locking member has a longitudinal axis that traverses the longitudinal axis of said body member during coupling thereof.

37. The locking system of claim 36 wherein the door mount comprises an interior mounting plate adapted to be mounted to an interior portion of the door, the interior mounting plate having a planar surface for contacting the interior portion of the door, and wherein the binding portion extends perpendicularly therefrom.

38. The locking system of claim 37 wherein the binding portion of the door mount comprises a protrusion, and wherein the binding end of the locking member comprises a thru-hole for receiving the protrusion such that when the protrusion is disposed in the thru-hole the locking member is securely linked to the door mount.

39. The locking system of claim 38 wherein the protrusion is parallel to the planar surface, and wherein the thru-hole is perpendicular to the axis of the locking member.

40. The locking system of claim 37 wherein the binding portion of the door mount comprises a thru-hole, and wherein the binding end of the locking member comprises a protrusion for placement in the thru-hole such that when the protrusion is disposed in the thru-hole the locking member is securely linked to the door mount.

41. The locking system of claim 40 wherein the thru-hole is parallel to the planar surface, and wherein the protrusion is perpendicular to the axis of the locking member.

42. The locking system of claim 37 wherein the door mount further comprises an exterior mounting plate, the exterior mounting plate having a planar surface for contacting an exterior portion of the door and a connecting element extending perpendicularly therefrom and having a threaded end, the interior mounting plate further having a threaded portion for receiving the threaded end, wherein the door mount is securely fixed to the door when the connecting element is inserted through an aperture in the door and the threaded end is fastened to the threaded portion.

43. The locking system of claim 42 wherein the exterior mounting plate is tapered to eliminate grasping edges.

44. The locking system of claim 36 wherein the floor mount is fixed to the surface of the floor with an anchor bolt, the anchor bolt having a threaded end and the floor mount having a threaded receptacle for receiving the threaded end, wherein the floor mount is securely fixed to the floor when the anchor bolt is positioned in the floor and the threaded end is fastened to the threaded receptacle.

45. The locking system of claim 36 wherein the floor mount has a planar surface for contacting the surface of the floor, and wherein the coupling portion of the floor mount comprises a protrusion extending perpendicularly therefrom, and wherein the coupling end of the body member comprises a cavity for receiving the protrusion, the protrusion and cavity being arranged to cooperate to securely link the body member to the floor mount.

46. The locking system of claim 45 wherein the linking of the protrusion and the cavity is arranged to position the body member perpendicular to the planar surface of the floor mount.

47. The locking system of claim 45 wherein the floor mount has a sloped surface opposite the planar surface, wherein the sloped surface is arranged with a relatively low profile to prevent accidents.

48. The locking system of claim 45 wherein the cavity forms a lip on the coupling end of the body member, and wherein the coupling portion of the floor mount comprises a channel that surrounds the protrusion and which is configured to receive the lip, the channel and the lip being arranged to cooperate to securely link the body member to the floor mount.

49. The locking system of claim 45 wherein the body member is rotatably movable relative to the floor mount when the body member is securely linked to the floor mount.

50. The locking system of claim 45 wherein the cavity comprises a magnet, and the protrusion comprises a magnetic surface, the magnet and the magnetic surface cooperating to further secure the body member to the floor mount.

51. The locking system of claim 45 wherein the protrusion comprises a magnet, and the cavity comprises a magnetic surface, the magnet and the magnetic surface cooperating to further secure the body member to the floor mount.

52. The locking system of claim 45 wherein the coupling portion of the floor mount comprises a sleeve extending perpendicularly from the planar surface of the floor mount and opposite the protrusion, the sleeve and the protrusion defining a recess, the body member further comprising a pin extending through the cavity for placement inside the recess, the pin and recess being arranged to cooperate to securely link the body member to the floor mount.

53. The locking system of claim 36 wherein the locking member has a second binding end, the second binding end being positioned symmetrically opposite the first binding end, and adapted to be engageable with the first binding portion of the door mount in order to securely link the locking member to the door mount.

54. The locking system of claim 36 wherein the locking member is slidably coupled to the body member.

55. The locking system of claim 54 wherein the body member comprises a through-hole, and wherein the locking member is dimensioned for sliding receipt through the through-hole of the body member.

56. The locking system of claim 55 wherein the through-hole is perpendicularly positioned relative to a longitudinal axis of the body member.

57. The locking system of claim 55 wherein the locking member comprises a sliding groove, and wherein the body member comprises a sliding nub, the sliding groove and the sliding nub cooperating to mechanically constrain the locking member to linear motion.

58. The locking system of claim 57 wherein the sliding nub is positioned inside the through hole of the body member.

59. The locking system of claim 55 further comprising a stop arrangement for preventing the movement of the locking member relative to the body member so as to hold the door relative to the floor.

60. The locking system of claim 59 wherein the stop arrangement is configured to position the locking member in at least a first position, holding the door in a door open position, and a second position, holding the door in a door shut position.

61. The locking system of claim 60 wherein the stop arrangement comprises at least a first abutment stop for positioning the locking member in the first position, the first abutment stop being longitudinally positioned on and proximate a first end of the locking member, and arranged to prevent the sliding of the locking member through a first side of the through-hole of the body member.

62. The locking system of claim 61 wherein the stop arrangement comprises a second abutment stop for positioning the locking member in the first position, the second abutment stop being longitudinally positioned proximate a second end of the locking member, and arranged to prevent the sliding of the locking member through a second side of the through-hole of the body member.

63. The locking system of claim 62 wherein the stop arrangement comprises a stop plate for positioning the locking member in the second position, the stop plate being pivotly coupled to the body member, the stop plate having a first pivot position, which allows the locking member to slide, and a second pivot position, which abuts to the first abutment stop thereby preventing the locking member from sliding relative to the body member.

64. The locking system of claim 63 wherein the stop plate has a third pivot position which abuts to the second abutment stop thereby preventing the locking member from sliding relative to the body member.

65. The locking system of claim 36 wherein the body member includes a permanent magnet to further secure the body member to the floor mount.

66. The locking system of claim 36 wherein the floor mount includes a permanent magnet to further secure the body member to the floor mount.

67. A locking system for holding a door relative to a floor, comprising:

a floor mount adapted to be securely fixed to the floor via a fastening mechanism, the floor mount including a bottom portion for contacting the floor and a top portion for receiving a component of the locking system, the bottom portion including a bottom planar surface, the top portion including a recess extending in a direction substantially normal to the bottom planar surface, the floor mount including a protrusion disposed inside the recess, the protrusion extending in a direction substantially normal to the bottom planar surface, the protrusion having an outer side surface that is spaced away from the inner side surface of the recess thereby forming a channel therebetween, the protrusion being configured to be inserted in a cavity disposed in the end of the body member in order to securely and removably link the body member to the floor mount; and a body member configured to carry a locking mechanism capable of being removably interlocked with the door so as to prevent movements of the door relative to the body member, the body member having an end adapted to be inserted into the recess of the floor mount in order to securely and removably link the body member to the floor mount, the end of the body member being dimensioned to substantially coincide with the shape of the recess such that the outer side surface of the body member substantially mates with the inner side surface of the recess when the end of the body member is inserted into the recess of the floor mount, the body member having a longitudinal axis, the longitudinal axis of the body member being substantially normal to the planar surface of the floor mount when the end of the body member is inserted into the recess of the floor mount.

68. The locking system of claim 67 wherein the protrusion includes a hole for receiving a rod that extends longitudinally from the end of the body member in order to securely and removably link the body member to the floor mount.

69. The locking system of claim 67 wherein the floor mounting plate further includes a sleeve extending from and in a direction normal to the bottom planar surface, the sleeve being configured to be embedded in an opening in the floor, the sleeve and protrusion defining a hole for receiving a rod that extends longitudinally from the end of the body member in order to securely and removably link the body member to the floor mount.

70. The locking system of claim 67 wherein the body member includes a permanent magnet to further secure the body member to the floor mount.

71. The locking system of claim 67 wherein the floor mount includes a permanent magnet to further secure the body member the floor mount.

72. The apparatus as recited in claim 24 wherein said stop arrangement comprises:

a stop ridge coupled to said locking member; and a stop plate pivotally coupled to said body member and arranged to engage a portion of said stop ridge, said stop ridge and said stop plate being configured to cooperate to prevent said locking member from sliding past said predetermined position when said stop plate is engaged with said stop ridge.

73. A home security kit for preventing opening movements of a door relative to a floor, the home security kit comprising:

a locking assembly that is installed and removed as a unit, the locking assembly comprising:

a body member configured to provide a secure and removable connection with said floor;

a locking member movably coupled to said body member, and being configured to temporarily engage said door; and a stop arrangement configured to prevent movement of said locking member relative to said body member so as to prevent said door from moving past a predefined door position when said body member is secured to said floor and when said locking member is engaged with said door; and a floor mounting plate configured to be mounted to said floor, said floor mounting plate providing a link between said floor and said locking assembly, said body member including a permanent magnet to further secure said body member to said floor mounting plate.

74. A home security kit for preventing opening movements of a door relative to a floor, the home security kit comprising:

a locking assembly that is installed and removed as a unit, the locking assembly comprising:

a body member configured to provide a secure and removable connection with said floor;

a locking member slidably coupled to said body member, and being configured to temporarily engage said door; and a stop arrangement configured to prevent movement of said locking member relative to said body member so as to prevent said door from moving past a predefined door position when said body member is secured to said floor and when said locking member is engaged with said door, said stop arrangement including a plurality of stopping means which prevent linear movements of the locking member relative to the body member, each of the stopping means defining a separate linear position of the locking member relative to the body member.

75. A locking system for holding a door relative to a floor, comprising:

a floor mount adapted to be securely fixed to the floor via a fastening mechanism, the floor mount including a bottom portion for contacting the floor and a top portion for receiving a component of the locking system, the bottom portion including a bottom planar surface, the top portion including a recess extending in a direction substantially normal to the bottom planar surface; and a body member configured to carry a locking mechanism capable of being removably interlocked with the door so as to prevent movements of the door relative to the body member, the body member having an end adapted to be inserted into the recess of the floor mount in order to securely and removably link the body member to the floor mount, the end of the body member being dimensioned to substantially coincide with the shape of the recess such that the outer side surface of the body member substantially mates with the inner side surface of the recess when the end of the body member is inserted into the recess of the floor mount, the body member having a longitudinal axis, the longitudinal axis of the body member being substantially normal to the planar surface of the floor mount when the end of the body member is inserted into the recess of the floor mount, the body member including a permanent magnet to further secure the body member to the floor mount.

76. A locking system for holding a door relative to a floor, comprising:

a floor mount adapted to be securely fixed to the floor via a fastening mechanism, the floor mount including a bottom portion for contacting the floor and a top portion for receiving a component of the locking system, the bottom portion including a bottom planar surface, the top portion including a recess extending in a direction substantially normal to the bottom planar surface; and a body member configured to carry a locking mechanism capable of being removably interlocked with the door so as to prevent movements of the door relative to the body member, the body member having an end adapted to be inserted into the recess of the floor mount in order to securely and removably link the body member to the floor mount, the end of the body member being dimensioned to substantially coincide with the shape of the recess such that the outer side surface of the body member substantially mates with the inner side surface of the recess when the end of the body member is inserted into the recess of the floor mount, the body member having a longitudinal axis, the longitudinal axis of the body member being substantially normal to the planar surface of the floor mount when the end of the body member is inserted into the recess of the floor mount, the floor mount including a permanent magnet to further secure the body member to the floor mount.

77. A locking system for holding a door relative to a floor, comprising:

a door mount adapted to be fixed to the door, the door mount having a binding portion;

a floor mount adapted to be fixed to the floor, the floor mount having a coupling portion;

a locking assembly that is installed and removed as a unit, the locking assembly comprising:

a body member having a coupling end adapted to be removably interlocked with the coupling portion of the floor mount in order to securely and removably link the body member to the floor mount; and a locking member coupled to the body member and having at least one binding end adapted to be removably interlocked with the binding portion of the door mount in order to securely and removably link the locking member to the door mount, wherein the body member includes a permanent magnet to further secure the body member to the floor mount.

78. A locking system for holding a door relative to a floor, comprising:

a door mount adapted to be fixed to the door, the door mount having a binding portion;

a floor mount adapted Lo be fixed to the floor, the floor mount having a coupling portion;

a locking assembly that is installed and removed as a unit, the locking assembly comprising:

a body member having a coupling end adapted to be removably interlocked with the coupling portion of the floor mount in order to securely and removably link the body member to the floor mount; and a locking member coupled to the body member and having at least one binding end adapted to be removably interlocked with the binding portion of the door mount in order to securely and removably link the locking member to the door mount, wherein the floor mount includes a permanent magnet to further secure the body member to the floor mount.

79. A locking system for holding a door relative to a floor, comprising:

a door mount adapted to be fixed to the door, the door mount comprising:

a binding portion, an interior mounting plate adapted to be mounted to an interior portion of the door, the interior mounting plate having a planar surface for contacting the interior portion of the door, the binding portion extending perpendicularly therefrom, the interior mounting plate further having a threaded portion, an exterior mounting plate having a planar surface for contacting an exterior portion of the door and a connecting element extending perpendicularly therefrom, the connecting member having a threaded end capable of being received by the threaded portion of the interior mounting plate, the door mount being securely fixed to the door when the connecting element is inserted through an aperture in the door and the threaded end is fastened to the threaded portion;

a floor mount adapted to be fixed to the floor, the floor mount having a coupling portion;

a locking assembly that is installed and removed as a unit, the locking assembly comprising:

a body member having a coupling end adapted to be removably interlocked with the coupling portion of the floor mount in order to securely and removably link the body member to the floor mount; and a locking member coupled to the body member and having at least one binding end adapted to be removably interlocked with the binding portion of the door mount in order to securely and removably link the locking member to the door mount.

80. The locking system of claim 79 wherein the exterior mounting plate is tapered to eliminate grasping edges.

81. A locking system for holding a door relative to a floor, comprising:

a door mount adapted to be fixed to the door, the door mount having a binding portion;

a floor mount adapted to be fixed to the floor, the floor mount having a coupling portion, the floor mount being fixed to the surface of the floor with an anchor bolt, the anchor bolt having a threaded end and the floor mount having a threaded receptacle for receiving the threaded end, the floor mount being securely fixed to the floor when the anchor bolt is positioned in the floor and the threaded end is fastened to the threaded receptacle;

a locking assembly that is installed and removed as a unit, the locking assembly comprising:

a body member having a coupling end adapted to be removably interlocked with the coupling portion of the floor mount in order to securely and removably link the body member to the floor mount; and a locking member coupled to the body member and having at least one binding end adapted to be removably interlocked with the binding portion of the door mount in order to securely and removably link the locking member to the door mount.

82. A locking system for holding a door relative to a floor, comprising:

a door mount adapted to be fixed to the door, the door mount having a binding portion;

a floor mount adapted to be fixed to the floor, the floor mount having a coupling portion and a planar surface for contacting the surface of the floor, the coupling portion of the floor mount comprising a protrusion extending perpendicularly therefrom;

a locking assembly that is installed and removed as a unit, the locking assembly comprising:

a body member having a coupling end adapted to be removably interlocked with the coupling portion of the floor mount in order to securely and removably link the body member to the floor mount, the coupling end of the body member comprising a cavity for receiving the protrusion of the floor mount, the protrusion and cavity being arranged to cooperate to securely link the body member to the floor mount, the cavity comprising a magnet, and the protrusion comprising a magnetic surface, the magnet and the magnetic surface cooperating to further secure the body member to the floor mount; and a locking member coupled to the body member and having at least one binding end adapted to be removably interlocked with the binding portion of the door mount in order to securely and removably link the locking member to the door mount.

83. A locking system for holding a door relative to a floor, comprising:

a door mount adapted to be fixed to the door, the door mount having a binding portion;

a floor mount adapted to be fixed to the floor, the floor mount having a coupling portion and a planar surface for contacting the surface of the floor, the coupling portion of the floor mount comprising a protrusion extending perpendicularly therefrom;

a locking assembly that is installed and removed as a unit, the locking assembly comprising:

a body member having a coupling end adapted to be removably interlocked with the coupling portion of the floor mount in order to securely and removably link the body member to the floor mount, the coupling end of the body member comprising a cavity for receiving the protrusion of the floor mount, the protrusion and cavity being arranged to cooperate to securely link the body member to the floor mount, the protrusion comprising a magnet, and the cavity comprising a magnetic surface, the magnet and the magnetic surface cooperating to further secure the body member to the floor mount; and a locking member coupled to the body member and having at least one binding end adapted to be removably interlocked with the binding portion of the door mount in order to securely and removably link the locking member to the door mount.

84. A locking system for holding a door relative to a floor, comprising:

a door mount adapted to be fixed to the door, the door mount having a binding portion;

a floor mount adapted to be fixed to the floor, the floor mount having a coupling portion and a planar surface for contacting the surface of the floor, the coupling portion of the floor mount comprising a protrusion extending perpendicularly therefrom, and a sleeve extending perpendicularly from the planar surface of the floor mount and opposite the protrusion, the sleeve and the protrusion defining a recess;

a locking assembly that is installed and removed as a unit, the locking assembly comprising:

a body member having a coupling end adapted to be removably interlocked with the coupling portion of the floor mount in order to securely and removably link the body member to the floor mount, the coupling end of the body member comprising a cavity for receiving the protrusion of the floor mount, the protrusion and cavity being arranged to cooperate to securely link the body member to the floor mount, the body member further comprising a pin extending through the cavity for placement inside the recess, the pin and recess being arranged to cooperate to securely link the body member to the floor mount; and a locking member coupled to the body member and having at least one binding end adapted to be removably interlocked with the binding portion of the door mount in order to securely and removably link the locking member to the door mount.

85. A locking system for holding a door relative to a floor, comprising:

a door mount adapted to be fixed to the door, the door mount having a binding portion;

a floor mount adapted to be fixed to the floor, the floor mount having a coupling portion;

a locking assembly that is installed and removed as a unit, the locking assembly comprising:

a body member having a coupling end adapted to be removably interlocked with the coupling portion of the floor mount in order to securely and removably link the body member to the floor mount, the body member comprising a through-hole and a sliding nub; and a locking member slidably coupled to the body member and having at least one binding end adapted to be removably interlocked with the binding portion of the door mount in order to securely and removably link the locking member to the door mount, the locking member being dimensioned for sliding receipt through the through-hole of the body member, the locking member comprising a sliding groove, the sliding groove cooperating with the sliding nub to mechanically constrain the locking member to linear motion.

86. The locking system of claim 85 wherein the sliding nub is positioned inside the through hole of the body member.

87. A locking system for holding a door relative to a floor, comprising:

a door mount adapted to be fixed to the door, the door mount having a binding portion;

a floor mount adapted to be fixed to the floor, the floor mount having a coupling portion;

a locking assembly that is installed and removed as a unit, the locking assembly comprising:

a body member having a coupling end adapted to be removably interlocked with the coupling portion of the floor mount in order to securely and removably link the body member to the floor mount; the body member comprising a through-hole; and a locking member slidably coupled to the body member and having at least one binding end adapted to be removably interlocked with the binding portion of the door mount in order to securely and removably link the locking member to the door mount, the locking member being dimensioned for sliding receipt through the through-hole of the body member;

a stop arrangement for preventing the movement of the locking member relative to the body member so as to hold the door relative to the floor, the stop arrangement being configured to position the locking member in at least a first position, holding the door in a door open position, and a second position, holding the door in a door shut position, the stop arrangement comprising at least a first abutment stop for positioning the locking member in the first position, the first abutment stop being longitudinally positioned on and proximate a first end of the locking member, and arranged to prevent the sliding of the locking member through a first side of the through-hole of the body member.

88. A locking system for holding a door relative to a floor, comprising:

a door mount adapted to be fixed to the door, the door mount having a binding portion;

a floor mount adapted to be fixed to the floor, the floor mount having a coupling portion;

a body member having a coupling end adapted to be engageable with the coupling portion of the floor mount in order to securely link the body member to the floor mount, the body member including a through-hole and a sliding nub; and a locking member slidably coupled to the body member and having at least one binding end adapted to be engageable with the binding portion of the door mount in order to securely link the locking member to the door mount, the locking member being dimensioned for sliding receipt through the through-hole of the body member, the locking member including a sliding groove that cooperates with the sliding nub to mechanically constrain the locking member to linear motion.

* * * * *